US009075327B2

(12) United States Patent
Yu

(10) Patent No.: US 9,075,327 B2
(45) Date of Patent: Jul. 7, 2015

(54) IMAGING MEMBERS AND METHODS FOR MAKING THE SAME

(71) Applicant: XEROX CORPORATION, Norwalk, CT (US)

(72) Inventor: Robert C. U. Yu, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 92 days.

(21) Appl. No.: 14/032,814

(22) Filed: Sep. 20, 2013

(65) Prior Publication Data

US 2015/0086914 A1 Mar. 26, 2015

(51) Int. Cl.

| | |
|---|---|
| ***G03G 5/00*** | (2006.01) |
| ***G03G 5/05*** | (2006.01) |
| ***G03G 5/06*** | (2006.01) |

(52) U.S. Cl.

CPC ..... *G03G 5/0592* (2013.01); *G03G 5/0614* (2013.01); *G03G 5/0564* (2013.01); *G03G 5/056* (2013.01)

(58) Field of Classification Search

CPC ..... G03G 5/0564; G03G 5/0592
USPC ..... 430/59.6, 58.05
See application file for complete search history.

(56) References Cited

U.S. PATENT DOCUMENTS

| | | | |
|---|---|---|---|
| 3,121,006 | A | 2/1964 | Middleton et al. |
| 3,820,989 | A | 6/1974 | Rule et al. |
| 3,837,851 | A | 9/1974 | Shattuck et al. |
| 3,895,944 | A | 7/1975 | Wiedemann et al. |
| 4,150,987 | A | 4/1979 | Anderson et al. |
| 4,245,021 | A | 1/1981 | Kazami et al. |
| 4,256,821 | A | 3/1981 | Enomoto et al. |
| 4,265,990 | A | 5/1981 | Stolka et al. |
| 4,278,746 | A | 7/1981 | Goto et al. |
| 4,286,033 | A | 8/1981 | Neyhart et al. |
| 4,291,110 | A | 9/1981 | Lee |
| 4,297,426 | A | 10/1981 | Sakai et al. |
| 4,315,982 | A | 2/1982 | Ishikawa et al. |
| 4,338,387 | A | 7/1982 | Hewitt |
| 4,338,388 | A | 7/1982 | Sakai et al. |
| 4,385,106 | A | 5/1983 | Sakai |
| 4,387,147 | A | 6/1983 | Sakai |
| 4,399,207 | A | 8/1983 | Sakai et al. |
| 4,399,208 | A | 8/1983 | Takasu et al. |
| 4,587,189 | A | 5/1986 | Hor et al. |
| 4,664,995 | A | 5/1987 | Horgan et al. |
| 4,988,597 | A | 1/1991 | Spiewak et al. |
| 5,244,762 | A | 9/1993 | Spiewak et al. |
| 5,697,024 | A | 12/1997 | Mishra |
| 5,703,487 | A | 12/1997 | Mishra |
| 5,756,245 | A | 5/1998 | Esteghamatian et al. |
| 6,008,653 | A | 12/1999 | Popovic et al. |
| 6,119,536 | A | 9/2000 | Popovic et al. |
| 6,124,514 | A | 9/2000 | Emmrich et al. |
| 6,150,824 | A | 11/2000 | Mishra et al. |
| 6,214,514 | B1 | 4/2001 | Evans et al. |

(Continued)

*Primary Examiner* — Mark A Chapman
(74) *Attorney, Agent, or Firm* — Pillsbury Winthrop Shaw Pittman LLP

(57) ABSTRACT

Flexible imaging members in electrophotography which have an improved plasticized charge transport layer formulation. The resulting imaging member is resistant to chemical contaminants, photoelectrically stable, fatigue cracking suppression, and has a simplified material structure which is curl-free without the need of an anticurl back coating layer. Process for making and using the member are also disclosed.

15 Claims, 5 Drawing Sheets

(56) References Cited

U.S. PATENT DOCUMENTS

| | | | | |
|---|---|---|---|---|
| 6,756,169 | B2 | 6/2004 | Lin et al. | |
| 6,933,089 | B2 | 8/2005 | Horgan et al. | |
| 7,018,756 | B2 | 3/2006 | Pai et al. | |
| 7,033,714 | B2 | 4/2006 | Horgan et al. | |
| 8,232,030 | B2 * | 7/2012 | Yu et al. | 430/58.05 |
| 8,263,298 | B1 * | 9/2012 | Yu et al. | 430/59.6 |
| 2011/0229808 | A1 * | 9/2011 | Yu et al. | 430/56 |
| 2012/0219893 | A1 * | 8/2012 | Yu et al. | 430/58.8 |

* cited by examiner

IMAGING MEMBERS AND METHODS FOR MAKING THE SAME

BACKGROUND

The presently disclosed embodiments are directed to flexible imaging members in electrostatography. More particularly, the embodiments pertain to an improved curl-free flexible electrophotographic imaging member prepared to give an imaging member resistant to chemical contaminants, photoelectrically stable, and having a simplified material structure without the need of an anticurl back coating layer, and a process for making and using the member.

In electrophotographic or electrostatographic reproducing apparatuses, including digital, image on image, and contact electrostatic printing apparatuses, a light image of an original to be copied is typically recorded in the form of an electrostatic latent image upon a photosensitive member and the latent image is subsequently rendered visible by the application of electroscopic thermoplastic resin particles and pigment particles, or toner. Typical flexible electrostatographic imaging members include, for example: (1) electrophotographic imaging member belts (belt photoreceptors) commonly utilized in electrophotographic (xerographic) processing systems; (2) electroreceptors such as ionographic imaging member belts for electrographic imaging systems; and (3) intermediate toner image transfer members such as an intermediate toner image transferring belt which is used to remove the toner images from a photoreceptor surface and then transfer the very images onto a receiving paper. The flexible electrostatographic imaging members may be seamless or seamed belts; and seamed belts are usually formed by cutting a rectangular sheet from a web, overlapping opposite ends, and welding the overlapped ends together to form a welded seam.

Typical electrophotographic imaging member belts include a charge transport layer and a charge generating layer on one side of a supporting substrate layer and an anticurl back coating coated onto the opposite side of the substrate layer. A typical electrographic imaging member belt includes a dielectric imaging layer on one side of a supporting substrate and an anticurl back coating on the opposite side of the substrate to render flatness. Although the scope of the present embodiments covers the preparation of all types of flexible electrostatographic imaging members, for reasons of simplicity, the discussion hereinafter will focus only on flexible electrophotographic imaging members.

Electrophotographic flexible imaging members may include a photoconductive layer including a single layer or composite layers. Since typical flexible electrophotographic imaging members exhibit undesirable upward imaging member curling, an anti-curl back coating, applied to the backside, is required to balance the curl. Thus, the application of anticurl back coating is necessary to provide the appropriate imaging member belt with desirable flatness.

One type of composite photoconductive layer used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer, the photoconductive layer is sandwiched between a contiguous charge transport layer and the supporting conductive layer. Alternatively, the charge transport layer may be sandwiched between the supporting electrode and a photoconductive layer. Photosensitive members having at least two electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a receiving member such as paper.

In the case where the charge generating layer is sandwiched between the outermost exposed charge transport layer and the electrically conducting layer, the outer surface of the charge transport layer is charged negatively and the conductive layer is charged positively. The charge generating layer then should be capable of generating electron hole pair when exposed image wise and inject only the holes through the charge transport layer. In the alternate case when the charge transport layer is sandwiched between the charge generating layer and the conductive layer, the outer surface of the charge generating layer is charged positively while conductive layer is charged negatively and the holes are injected through from the charge generating layer to the charge transport layer. The charge transport layer should be able to transport the holes with as little trapping of charge as possible. In flexible imaging member belt such as photoreceptor, the charge conductive layer may be a thin coating of metal on a flexible substrate support layer.

Typical negatively-charged electrophotographic imaging member belts, such as flexible photoreceptor belt designs, are made of multiple layers including a flexible supporting substrate, a conductive ground plane, a charge blocking layer, an optional adhesive layer, a charge generating layer, and a charge transport layer. The charge transport layer is usually located at the outermost layer. The charge transport layer is generally coated and dried at elevated temperatures (e.g., about 120° C.), and then cooled down to ambient room temperatures. Normally, an upward curling of the multilayered photoreceptor is observed during the manufacturing of the web stock of coated multilayered photoreceptor materials, which is a consequence of thermal contraction mismatch between the charge transport layer and the substrate support due to the heating/cooling processing step. According to the mechanism: (a) as the web stock carrying the wet applied charge transport layer is dried at elevated temperature, dimensional contraction does occur when the wet charge transport layer coating is losing its solvent during 120° C. elevated temperature drying, but at 120° C. the charge transport layer remains as a viscous flowing liquid after losing its solvent. Since its glass transition temperature (Tg) is at 85° C., the charge transport layer after losing of solvent will flow to re-adjust itself, release internal stress, and maintain its dimension stability; (b) as the charge transport layer now in the viscous liquid state is cooling down further and reaching its glass transition temperature (Tg) at 85° C., the CTL instantaneously solidifies and adheres to the charge generating layer because it has then transformed itself from being a viscous liquid into a solid layer at its Tg; and (c) eventual cooling down the solid charge transport layer of the imaging member web from 85° C. down to 25° C. room ambient will then cause the charge transport layer to contract more than the substrate support since it has about 3.7 times greater thermal coefficient of dimensional contraction than that of the substrate support. This differential in dimensional contraction results in tension strain built-up in the charge transport layer which therefore, at this instant, pulls the imaging member upward to exhibit curling. If unrestrained at this point, the imaging member web stock will spontaneously curl upwardly into a 1.5-inch tube. To offset the curling, an anticurl back coating is applied to the backside of the flexible substrate support, opposite to the side having the charge transport layer, and render the imaging member web stock with desired flatness.

Curling of an electrophotographic imaging member web is undesirable because it hinders fabrication of the web into cut sheets and subsequent welding into a belt. An anticurl back coating, having an equal counter curling effect but in the opposite direction to the applied imaging layer(s), is applied to the reverse side of substrate support of the active imaging member to balance the curl caused by the mismatch of the thermal contraction coefficient between the substrate and the charge transport layer, resulting in greater charge transport layer dimensional shrinkage than that of the substrate. Although the application of an anticurl back coating is effective to counter and remove the curl, nonetheless the resulting imaging member in flat configuration does tension the charge transport layer creating an internal build-in strain of about 0.27% in the layer. The magnitude of CTL internal build-in strain is very undesirable, because it is additive to the induced bending strain of an imaging member belt as the belt bends and flexes over each belt support roller during dynamic fatigue belt cyclic motion under a normal machine electrophotographic imaging function condition in the field. The summation of the internal strain and the cumulative fatigue bending strain sustained in the charge transport layer has been found to exacerbate the early onset of charge transport layer cracking, preventing the belt to reach its targeted functional imaging life. Moreover, imaging member belt employing an anticurl backing coating has additional total belt thickness to thereby increase charge transport layer bending strain as it flexes over each belt support rollers and speed up belt cycling fatigue charge transport layer cracking. The cracks formed in the charge transport layer as a result of dynamic belt fatiguing are found to manifest themselves into copy print-out defects, which thereby adversely affect the image quality on the receiving paper.

Curling has a further undesirable impact under a normal imaging belt machine functioning condition, because different segments of the imaging surface of the photoconductive member are located at different distances from charging devices, causing non-uniform charging for proper latent image formation. Therefore, developer applicators and the like, during the electrophotographic imaging process, may all adversely affect the quality of the ultimate developed images in the printout copy. For example, non-uniform charging distances can manifest as variations in high background deposits during development of electrostatic latent images near the edges of paper. Since the anticurl back coating is an outermost exposed backing layer and has high surface contact friction when it slides and flexes over the machine subsystems of the belt support module, such as rollers, stationary belt guiding components, and backer bars, during dynamic belt cyclic function, these mechanical sliding interactions against the belt support module components not only exacerbate anticurl back coating wear to lose its anti-curling control capability to result in imaging member belt curling-up problem, it does also generate of debris/dirt which scatters and deposits on critical machine components such as lenses, corona charging devices and the like, thereby adversely affecting machine performance. Moreover, anticurl back coating abrasion/scratch damage does also produce unbalance forces generation between the charge transport layer and the anticurl back coating to cause micro belt ripples formation during electrophotographic imaging processes, resulting in streak line print defects in output copies to deleteriously impact image print-out quality and shorten the imaging member belt functional life.

Undesirably, high contact friction of the anticurl back coating against machine subsystems is further seen to cause the development of tribo-electrostatic charge built-up problem. In other machines the electrostatic charge builds up due to contact friction between the anti-curl layer and the backer bars increases the friction and thus requires higher torque to pull the belts. In full color machines with 10 pitches this can be extremely high due to large number of backer bars used. At times, one has to use two drive rollers rather than one which are to be coordinated electronically precisely to prevent any possibility of sagging. Static charge built-up in anticurl back coating by frictional action on the anticurl back coating increases belt drive torque, in some instances, has also been found to result in absolute belt stalling. In other cases, the electrostatic charge build up can be so high as to cause sparking.

Another problem encountered in the conventional belt photoreceptors using a bisphenol A polycarbonate anticurl back coating that are extensively cycled in precision electrostatographic imaging machines utilizing belt supporting backer bars, is an audible squeaky sound generated due to high contact friction interaction between the anticurl back coating and the backer bars. Further, cumulative deposition of anticurl back coating wear debris onto the backer bars may give rise to undesirable defect print marks formed on copies because each debris deposit become a surface protrusion point on the backer bar and locally forces the imaging member belt upwardly to interferes with the toner image development process. On other occasions, the anticurl back coating wear debris accumulation on the backer bars does gradually increase the dynamic contact friction between these two interacting surfaces of anticurl back coating and backer bar, interfering with the duty cycle of the driving motor to a point where the motor eventually stalls and belt cycling prematurely ceases. Additionally, it is important to point out that electrophotographic imaging member belts that required anticurl back coating to provide flatness have more than above list of problems, they do indeed incur additional material and labor cost impact to imaging members' production process.

Since the charge transport layer in the negatively charged flexible imaging member is the top outermost exposed layer, it is constantly subjected to chemical vapor contaminants exposure/interaction during electrophotographic imaging process in the field to negatively impact function. For example, exposure to the vapor amine species (from ammonia) emitted from common house cleaning agents have been seen to interact with the imaging member charge transport layer, causing material degradation to promote pre-mature onset of charge transport layer cracking and exacerbation of wear failure which severely cut short the functional life of the imaging member. In one particular instant, amine vapor impact on copy printout quality degradation has recently been seen when pre-printed papers (papers having pre-printed images which employed amine agents catalyzed UV cured ink) are used by customers for subsequent addition of xerographic images over the pre-printed paper blank spaces; that is the accumulation of amine residues deposition onto the imaging member charge transport layer surface, after repeatedly making contact with receiving papers during xerographic imaging process, is found to cause ghosting image defects print-out in the output copies to severely degrade copy quality. Since ghosting image defects in the output copies are unacceptable print quality failures, so it does require immediate termination of belt function for replacement.

Moreover, the imaging members do also exhibit typical mechanical failures such as charge transport layer cracking when functioned under the normal machine electrophotographic imaging service conditions. The frequently seen charge transport layer cracking failure is unique in belt members, as it is induced by dynamic fatigue belt flexing over the supporting rollers of a machine belt support module and exacerbated by exposure to ozone in the corona species emitted by machine charging devices since ozone attack the polymer binder in the charge transport layer causing polymer chain scission and fragmentation.

In addition, for typical imaging members of the conventional designs, they do all have an inherent photoelectrical instability shortfall, such as for example, the monotonously increase in electrical property cycle-up during electrophotographic imaging process has always been found to be a critical issue, because this electrical cycle-up limits the imaging members practical application value as it shortens the imaging member's functional life in the field.

The above mentioned shortcomings and failures pre-maturely cut short the imaging member function and prevent the imaging member from reaching the intended full service life and require frequent costly replacement in the field. A practical solution to resolve all the issues is therefore urgently needed for achieving imaging member production quality and cost delivery objective.

BRIEF SUMMARY

According to embodiments illustrated herein, there is provided a self-cleaning toner composition comprising a silicone oil that addresses the shortcomings discussed above.

An embodiment may include a flexible imaging member comprising: a flexible substrate; a charge generating layer disposed on a first side of the substrate; and at least one plasticized charge transport layer disposed on the charge generating layer, wherein the plasticized charge transport layer comprises a charge transport compound molecularly dispersed or dissolved in an A-B diblock copolymer binder and a plasticizer to form a solid solution, the A-B diblock copolymer binder comprising a bisphenol polycarbonate block (A) and an organic acid containing block (B) and having a general formula of $$R_1-(\text{[Block A]}_z-\text{[Block B]}_y)_n-OH$$

wherein block A is a polycarbonate repeating unit, block B is an organic acid containing repeating unit, z is from about 9 to about 54, y is from about 1 to about 6, n is between about 20 and about 80, and $R_1$ is H or $CH_3$, and further wherein the plasticizer in the plasticized charge transport layer comprises a vinyl group, Embodiments may include a flexible imaging member comprising: a flexible substrate; a single plasticized imaging layer disposed on the substrate, wherein the single plasticized imaging layer disposed on the substrate has both charge generating and charge transporting capability and the single plasticized imaging layer comprises a photo-generating pigment and charge transport compound molecularly dispersed or dissolved in an A-B diblock copolymer binder and a plasticizer to form a solid solution, the A-B diblock copolymer binder comprising a bisphenol polycarbonate block (A) and an organic acid containing block (B) and having a general formula of:

$$R_1-(\text{[Block A]}_z-\text{[Block B]}_y)_n-OH$$

wherein block A is a polycarbonate repeating unit, block B is an organic acid containing repeating unit, z is from about 9 to about 54, y is from about 1 to about 6, n is between about 20 and about 80, and $R_1$ is H or $CH_3$, and further wherein the single imaging layer comprises a vinyl-containing plasticizer.

Yet further embodiments may include an image forming apparatus for forming images on a recording medium comprising: a) a flexible imaging member having a charge retentive-surface for receiving an electrostatic latent image thereon, wherein the imaging member comprises a flexible substrate; a charge generating layer disposed on a first side of the substrate; and at least one plasticized charge transport layer disposed on the charge generating layer, wherein the charge transport layer comprises a charge transport compound molecularly dispersed or dissolved in an A-B diblock copolymer binder and a plasticizer to form a solid solution, the A-B diblock copolymer binder comprising a bisphenol polycarbonate block (A) and an organic acid containing block (B) and having a general formula of:

$$R_1-(\text{[Block A]}_z-\text{[Block B]}_y)_n-OH$$

wherein block (A) is a polycarbonate repeating unit, block (B) is an organic acid containing repeating unit, z is from about 9 to about 54, y is from about 1 to about 6, n is between about 20 and about 80, and $R_1$ is H or $CH_3$, and further wherein the charge transport layer comprises a vinyl-containing plasticizer; b) a development component for applying a developer material to the charge-retentive surface to develop the lectrostatic latent image to form a developed image on the charge-retentive surface; c) a transfer component for transferring the developed image from the charge-retentive surface to a copy substrate; and d) a fusing component for fusing the developed image to the copy substrate.

BRIEF DESCRIPTION OF THE DRAWINGS

For a better understanding of the present disclosure, reference may be made to the accompanying figures.

DETAILED DESCRIPTION OF DRAWINGS

Figure 1:
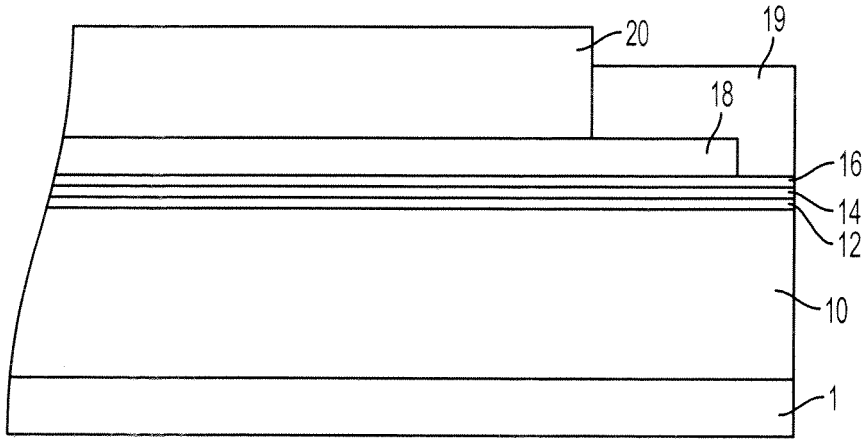
FIG. 1 is a cross-sectional view of a flexible multilayered electrophotographic imaging member having the configuration and structural design according to the conventional prior art.

In the following description, reference is made to the accompanying drawings, which form a part hereof and which illustrate several embodiments. It is understood that other embodiments may be utilized and material formulation redesigned/modifications and operational changes may be made without departure from the scope of the present embodiments.

According to aspects illustrated herein, there is provided negatively charged flexible imaging members prepared to have a reformulated charge transport layer, comprising a charge transport compound, a novel high molecular weight film forming A-B diblock copolymer binder, and an ozone quenching high boiling plasticizer, so that the charge transport layer as formulated provides the resulting imaging members with photoelectrical stability, chemical resistivity as well as providing for the elimination of an anticurl backing coating to render flatness.

In the typical conventional imaging member preparation embodiments, the flexible electrophotographic imaging member is comprised of a flexible substrate, a charge generating layer disposed on the substrate, and at least one charge transport layer disposed on the charge generating layer, and an anticurl back coating applied to the opposite side of the substrate to render imaging member flatness. The charge transport layer prepared according to the conventional formulation comprises a charge transport compound molecularly dispersed or dissolved in a conventional bisphenol polycarbonate binder; in specific embodiments, the standard charge transport layer in the flexible electrophotographic imaging member is a solid solution comprised of a charge transport compound of N,N'-diphenyl-N,N'-bis(3-methylphenyl)-1,1-biphenyl-4,4'-diamine and a conventional film forming bisphenol A polycarbonate of poly(4,4'-isopropylidene diphenyl carbonate). The bisphenol A polycarbonate (PCA) used as binder for the formation of the conventional charge transport layer has a weight average molecular weight (Mw) of from about 50,000 to about 200,000 and is shown in the molecular formula below:

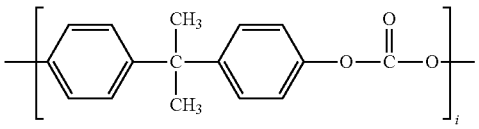

wherein I is the degree of polymerization, and is a positive integer of between 20 and about 80.

In the imaging member preparation embodiments of this disclosure, the flexible electrophotographic imaging member is an anticurl back coating-less imaging member which is prepared to comprise of a flexible substrate, a charge generating layer disposed on the substrate, and at least one charge transport layer disposed on the charge generating layer. The charge transport layer is a reformulation of this disclosure to have internal stress/strain relief for effecting imaging member curl control. In essence, the charge transport layer of this disclosure is comprised of a charge transport compound, a selected organic acid containing A-B diblock copolymer, and vinyl containing plasticizer. In the specific embodiments, the disclosed charge transport layer in the flexible anticurl back coating-less electrophotographic imaging member is formulated to comprise a charge transport compound of N,N'-diphenyl-N,N'-bis(3-methylphenyl)-1,1-biphenyl-4,4'-diamine, a film forming high molecular weight organic acid containing A-B diblock copolymer to provide chemical amine protection as well as electrical cyclic stability, and plus an antiozonant vinyl containing plasticizer incorporation to render charge transport layer internal stress/strain relief for effecting imaging member curl control.

The organic acid terminated A-B diblock copolymer used as binder in the charge transport layer reformulation is a linear saturated polymer having a general Molecular Formula (I) representation shown below:

$$R_1-(-[\text{Block A}]_z-[\text{Block B}]_y-)_n-OH \qquad \text{Formula (I)}$$

wherein block A is a polycarbonate repeating unit, block B is an organic acid containing repeating unit, z represents the number of carbonate repeating units of block A and is, for example, from about 9 to about 18, from about 27 to about 36, or from about 45 to about 54, y represents the number of organic acid containing repeating units of block B and is, for example, from about 1 to about 6, or from about 1 to about 2, n represents the degree of polymerization of the A-B diblock copolymer, which can be between about 20 and about 80, between about 30 and about 70, or between about 40 and about 60, $R_1$ is H or $CH_3$. The copolymer typically has a weight average molecular weight of between about 80,000 and about 250,000 or between about 100,000 and about 200,000, or between about 110,000 and about 150,000.

The applicable plasticizers selected for the disclosed charge transport layer incorporation are high boiling liquids comprising phthalates, carbonates, bisphenol carbonate monomers, and oligomeric styrenes.

For purposes of this disclosure, the term "A-B diblock copolymer" is defined as one in which identical mer units are clusterered in blocks along the copolymer chain backbone. Such definition can be found in MATERIALS SCIENCE AND ENGINEERING: An Introduction, Third Edition, William D. Callister, Jr., John Wiley & Sons, Inc. pp, 460-461 (1994).

A typical conventional negatively charged flexible electrophotographic imaging member is illustrated in FIG. 1. The substrate 10 has an optional conductive layer 12. An optional hole blocking layer 14 disposed onto the conductive layer 12 is coated over with an optional adhesive layer 16. The charge generating layer 18 is located between the adhesive layer 16 and the charge transport layer 20. An optional ground strip layer 19 operatively connects the charge generating layer 18 and the charge transport layer 20 to the conductive ground plane 12, and an optional overcoat layer 32 is applied over the charge transport layer 20. An anti-curl backing layer 1 is applied to the side of the substrate 10 opposite from the electrically active layers to render imaging member flatness.

The layers of the imaging member include, for example, an optional ground strip layer 19 that is applied to one edge of the imaging member to promote electrical continuity with the conductive ground plane 12 through the hole blocking layer 14. The conductive ground plane 12, which is typically a thin metallic layer, for example a 10 nanometer thick titanium coating, may be deposited over the substrate 10 by vacuum deposition or sputtering process. The other layers 14, 16, 18, 20 and 43 are to be separately and sequentially deposited, onto to the surface of conductive ground plane 12 of substrate 10 respectively, as wet coating layer of solutions comprising a solvent, with each layer being dried before deposition of the next subsequent one. An anticurl back coating layer 1 may then be formed on the backside of the support substrate 1. The anticurl back coating 1 is also solution coated, but is applied to the back side (the side opposite to all the other layers) of substrate 1, to render imaging member flatness.

The Substrate

The imaging member support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and or oxides.

The support substrate 10 can also be formulated entirely of an electrically conductive material, or it can be an insulating material including inorganic or organic polymeric materials, such as, MYLAR, a commercially available biaxially oriented polyethylene terephthalate from DuPont, or polyethylene naphthalate (PEN) available as KALEDEX 2000, with a ground plane layer comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations. The substrate may have a number of many different configurations, such as, for example, a plate, a drum, a scroll, an endless flexible belt, and the like. In one embodiment, the substrate is in the form of a seamed flexible belt.

The thickness of the support substrate 10 depends on numerous factors, including flexibility, mechanical performance, and economic considerations. The thickness of the support substrate may range from about 50 micrometers to about 3,000 micrometers. In embodiments of flexible imaging member belt preparation, the thickness of substrate used is from about 50 micrometers to about 200 micrometers for achieving optimum flexibility and to effect tolerable induced imaging member belt surface bending stress/strain when a belt is cycled around small diameter rollers in a machine belt support module, for example, the 19 millimeter diameter rollers.

An exemplary functioning support substrate 10 is not soluble in any of the solvents used in each coating layer solution, has good optical transparency, and is thermally stable up to a high temperature of at least 150° C. A typical support substrate 10 used for imaging member fabrication has a thermal contraction coefficient ranging from about $1\times10^{-5}$/° C. to about $3\times10^{-5}$/° C. and a Young's Modulus of between about $5\times10^{-5}$ psi ($3.5\times10^{-4}$ Kg/cm2) and about $7\times10^{-5}$ psi ($4.9\times10^{-4}$ Kg/cm2).

The Conductive Ground Plane

The conductive ground plane layer 12 may vary in thickness depending on the optical transparency and flexibility desired for the electrophotographic imaging member. For a typical flexible imaging member belt, it is desired that the thickness of the conductive ground plane 12 on the support substrate 10, for example, a titanium and/or zirconium conductive layer produced by a sputtered deposition process, is in the range of from about 2 nanometers to about 75 nanometers to effect adequate light transmission through for proper back erase. In particular embodiments, the range is from about 10 nanometers to about 20 nanometers to provide optimum combination of electrical conductivity, flexibility, and light transmission. For electrophotographic imaging process employing back exposure erase approach, a conductive ground plane light transparency of at least about 15 percent is generally desirable. The conductive ground plane need is not limited to metals. Nonetheless, the conductive ground plane 12 has usually been an electrically conductive metal layer which may be formed, for example, on the substrate by any suitable coating technique, such as a vacuum depositing or sputtering technique. Typical metals suitable for use as conductive ground plane include aluminum, zirconium, niobium, tantalum, vanadium, hafnium, titanium, nickel, stainless steel, chromium, tungsten, molybdenum, combinations thereof, and the like. Other examples of conductive ground plane 12 may be combinations of materials such as conductive indium tin oxide as a transparent layer for light having a wavelength between about 4000 Angstroms and about 9000 Angstroms or a conductive carbon black dispersed in a plastic binder as an opaque conductive layer. However, in the event where the entire substrate is chosen to be an electrically conductive metal, such as in the case that the electrophotographic imaging process designed to use front exposure erase, the outer surface thereof can perform the function of an electrically conductive ground plane so that a separate electrical conductive layer 12 may be omitted.

For the reason of convenience, all the illustrated embodiments herein after will be described in terms of a substrate layer 10 comprising an insulating material including organic polymeric materials, such as, polyethylene terephthalate (MYLAR) or polyethylene naphthalate (PEN) having a conductive ground plane 12 comprising of an electrically conductive material, such as titanium or titanium/zirconium, coating over the support substrate 10.

The Hole Blocking Layer

A hole blocking layer 14 may then be applied to the conductive ground plane 12 of the support substrate 10. Any suitable positive charge (hole) blocking layer capable of forming an effective barrier to the injection of holes from the adjacent conductive layer 12 into the overlaying photoconductive or photogenerating layer may be utilized. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may comprise nitrogen containing siloxanes or silanes, or nitrogen containing titanium or zirconium compounds, such as, titanate and zirconate. The hole blocking layer 14 may have a thickness in wide range of from about 5 nanometers to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta- (aminoethyl)gamma-aminopropyl trimethoxy silane, isopropyl 4-aminobenzene sulfonyl di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (gamma-aminobutyl)methyl diethoxysilane which has the formula [H2N(CH2)4]CH3Si(OCH3)2, and (gamma-aminopropyl) methyl diethoxysilane, which has the formula [H2N(CH2)3] CH33Si(OCH3)2, and combinations thereof, as disclosed, for example, in U.S. Pat. Nos. 4,338,387; 4,286,033; and 4,291,110, incorporated herein by reference in their entireties. A specific hole blocking layer comprises a reaction product between a hydrolyzed silane or mixture of hydrolyzed silanes and the oxidized surface of a metal ground plane layer. The oxidized surface forms on the outer surface of most metal ground plane layers when exposed to air after deposition. This combination enhances electrical stability at low RH. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly(2-hydroxyethyl methacrylate) blended with the parent polymer poly(2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of these U.S. patents are incorporated herein by reference in their entireties.

The hole blocking layer 14 can be continuous or substantially continuous and may have a thickness of less than about 10 micrometers because greater thicknesses may lead to undesirably high residual voltage. In aspects of the exemplary embodiment, a blocking layer of from about 0.005 micrometers to about 2 micrometers gives optimum electrical performance. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of between about 0.05:100 to about 5:100 is satisfactory for spray coating.

The Adhesive Interface Layer

An optional separate adhesive interface layer 16 may be provided. In the embodiment illustrated in FIG. 1, an interface layer 16 is situated intermediate the blocking layer 14 and the charge generator layer 18. The adhesive interface layer 16 may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-1200, VITEL PE-2200, VITEL PE-2200D, and VITEL PE-2222, all from Bostik, 49,000 polyester from Rohm Hass, polyvinyl butyral, and the like. The adhesive interface layer 16 may be applied directly to the hole blocking layer 14. Thus, the adhesive interface layer 16 in embodiments is in direct contiguous contact with both the underlying hole blocking layer 14 and the overlying charge generator layer 18 to enhance adhesion bonding to provide linkage. However, in some alternative electrophotographic imaging member designs, the adhesive interface layer 16 is entirely omitted.

Any suitable solvent or solvent mixtures may be employed to form a coating solution of the polyester for the adhesive interface layer 36. Typical solvents include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer 16 may have a thickness of from about 0.01 micrometers to about 900 micrometers after drying. In embodiments, the dried thickness is from about 0.03 micrometers to about 1 micrometer.

The Charge Generating Layer

The photogenerating (e.g., charge generating) layer 18 may thereafter be applied to the adhesive layer 16. Any suitable charge generating binder layer 18 including a photogenerating/photoconductive material, which may be in the form of particles and dispersed in a film forming binder, such as an inactive resin, may be utilized. Examples of photogenerating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. The photogenerating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the photogenerating layer 18, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like.

An exemplary film forming polymer binder used for the charge generating layer 18 is PCZ-400 (poly(4,4'-dihydroxydiphenyl-1-1-cyclohexane) which has a molecular weight of about 40,000 and is available from Mitsubishi Gas Chemical Corporation.

The photogenerating material can be present in the resinous binder composition in various amounts. Generally, from about 5 percent by volume to about 90 percent by volume of the photogenerating material is dispersed in about 10 percent by volume to about 95 percent by volume of the resinous binder, and more specifically from about 20 percent by volume to about 30 percent by volume of the photo generating material is dispersed in about 70 percent by volume to about 80 percent by volume of the resinous binder composition.

The photogenerating layer 18 containing the photogenerating material and the resinous binder material generally ranges in thickness of from about 0.1 micrometer to about 5 micrometers, for example, from about 0.3 micrometers to about 3 micrometers when dry. The photogenerating layer thickness is generally related to binder content. Higher binder content compositions generally employ thicker layers for photogeneration.

The Ground Strip Layer

Other layers such as conventional ground strip layer 19 including, for example, conductive particles dispersed in a film forming binder may be applied to one edge of the imaging member to promote electrical continuity with the conductive ground plane 12 through the hole blocking layer 14. Ground strip layer may include any suitable film forming polymer binder and electrically conductive particles. Typical ground strip materials include those enumerated in U.S. Pat. No. 4,664,995, the entire disclosure of which is incorporated by reference herein. The ground strip layer 19 may have a thickness from about 7 micrometers to about 42 micrometers, for example, from about 14 micrometers to about 23 micrometers.

The Charge Transport Layer

The charge transport layer 20 is thereafter applied over the charge generating layer 18 and become, as shown in FIG. 1, the exposed outermost layer of the imaging member. It may include any suitable transparent organic polymer or non-polymeric material capable of supporting the injection of photogenerated holes or electrons from the charge generating layer 18 and capable of allowing the transport of these holes/electrons through the charge transport layer to selectively discharge the surface charge on the imaging member surface. In one embodiment, the charge transport layer 20 not only serves to transport holes, but also protects the charge generating layer 18 from abrasion or chemical attack and may therefore extend the service life of the imaging member. The charge transport layer 20 can be a substantially non-photoconductive material, but one which supports the injection of photogenerated holes from the charge generation layer 18. The charge transport layer 20 is normally transparent in a wavelength region in which the electrophotographic imaging member is to be used when exposure is effected therethrough to ensure that most of the incident radiation is utilized by the underlying charge generating layer 18. The charge transport layer should exhibit excellent optical transparency with negligible light absorption and neither charge generation nor discharge if any, when exposed to a wavelength of light useful in xerography, e.g., 400 to 900 nanometers. In the case when the imaging member is prepared with the use of a transparent support substrate 10 and also a transparent conductive ground plane 12, image wise exposure or erase may be accomplished through the substrate 10 with all light passing through the back side of the support substrate 10. In this particular case, the materials of the charge transport layer 20 need not have to be able to transmit light in the wavelength region of use for electrophotographic imaging processes if the charge generating layer 18 is sandwiched between the support substrate 10 and the charge transport layer 20. In all events, the exposed outermost charge transport layer 20 in conjunction with the charge generating layer 18 is an insulator to the extent that an electrostatic charge deposited/placed over the charge transport layer is not conducted in the absence of radiant illumination. Importantly, the charge transport layer 20 should trap minimal or no charges as the charge pass through it during the image copying/printing process.

The charge transport layer 20 may include any suitable charge transport component or activating compound useful as an additive molecularly dispersed in an electrically inactive polymeric material to form a solid solution and thereby making this material electrically active. The charge transport component may be added to a film forming polymeric material which is otherwise incapable of supporting the injection of photo generated holes from the generation material and incapable of allowing the transport of these holes there through. This converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The charge transport component typically comprises small molecules of an organic compound which cooperate to transport charge between molecules and ultimately to the surface of the charge transport layer.

Any suitable inactive resin binder soluble in methylene chloride, chlorobenzene, or other suitable solvent may be employed in the charge transport layer. Exemplary binders include polyesters, polyvinyl butyrals, polycarbonates, polystyrene, polyvinyl formals, and combinations thereof. The polymer binder used for the charge transport layers may be, for example, selected from the group consisting of polycarbonates, poly(vinyl carbazole), polystyrene, polyester, polyarylate, polyacrylate, polyether, polysulfone, combinations thereof, and the like. Exemplary polycarbonates include poly(4,4'-isopropylidene diphenyl carbonate), poly(4,4'-diphenyl-1,1'-cyclohexane carbonate), and combinations thereof. The molecular weight of the polymer binder used in the charge transport layer can be, for example, from about 20,000 to about 1,500,000.

Exemplary charge transport components include aromatic polyamines, such as aryl diamines and aryl triamines. Exemplary aromatic diamines include N,N'-diphenyl-N,N'-bis(alkylphenyl)-1,1'-biphenyl-4,4-diamines, such as mTBD, which has the formula (N,N'-diphenyl-N,N'-bis[3-methylphenyl]-[1,1'-biphenyl]-4,4'-diamine); N,N'-diphenyl-N, N'-bis(chlorophenyl)-1,1'-biphenyl-4,4'-diamine; and N,N'-bis-(4-methylphenyl)-N,N'-bis(4-ethylphenyl)-1,1'-3,3'-dimethylbiphenyl)-4,4'-diamine (Ae-16), N,N'-bis-(3,4-dimethylphenyl)-4,4'-biphenyl amine (Ae-18), and combinations thereof.

Other suitable charge transport components include pyrazolines, such as 1-[lepidyl-(2)]-3-(p-diethylaminophenyl)-5-(p-diethylaminophenyl)pyrazoline, as described, for example, in U.S. Pat. Nos. 4,315,982, 4,278,746, 3,837,851, and 6,214,514, substituted fluorene charge transport molecules, such as 9-(4'-dimethylaminobenzylidene)fluorene, as described in U.S. Pat. Nos. 4,245,021 and 6,214,514, oxadiazole transport molecules, such as 2,5-bis(4-diethylaminophenyl)-1,3,4-oxadiazole, pyrazoline, imidazole, triazole, as described, for example in U.S. Pat. No. 3,895,944, hydrazones, such as p-diethylaminobenzaldehyde (diphenylhydrazone), as described, for example in U.S. Pat. Nos. 4,150,987 4,256,821, 4,297,426, 4,338,388, 4,385,106, 4,387,147, 4,399,207, 4,399,208, 6,124,514, and tri-substituted methanes, such as alkyl-bis(N,N-dialkylaminoaryl)methanes, as described, for example, in U.S. Pat. No. 3,820,989. The disclosures of all of these patents are incorporated herein by reference in their entireties.

The concentration of the charge transport component in layer 20 may be, for example, at least about 5 weight % and may comprise up to about 60 weight %. The concentration or composition of the charge transport component may vary through layer 20, as disclosed, for example, in U.S. Pat. No. 7,033,714; U.S. Pat. No. 6,933,089; and U.S. Pat. No. 7,018, 756, the disclosures of which are incorporated herein by reference in their entireties.

In one exemplary embodiment, charge transport layer 20 comprises an average of about 10 to about 60 weight percent N,N'-diphenyl-N,N'-bis(3-methylphenyl)-1,1'-biphenyl-4, 4'-diamine, or from about 30 to about 50 weight percent N,N'-diphenyl-N,N'-bis(3-methylphenyl)-1,1'-biphenyl-4, 4'-diamine.

The charge transport layer 20 is an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer 20 to the charge generator layer 18 is maintained from about 2:1 to about 200:1 and in some instances as great as about 400:1.

The charge transport layer 20 is a solid solution including a charge transport component, such as N,N'-diphenyl-N,N'-bis(3-methylphenyl)-1,1'-biphenyl-4,4'-diamine (m-TBD), molecularly dispersed/dissolved in a polycarbonate binder, the polycarbonate binder is typically a bisphenol A polycarbonate of poly(4,4'-isopropylidene diphenyl carbonate). The bisphenol A polycarbonate used for typical charge transport layer formulation is FPC 0170, having a molecular weight of about 120,000 and commercially available from Mitsubishi Chemicals Corp. The molecular structure of bisphenol A polycarbonate, poly(4,4'-isopropylidene diphenyl carbonate), is given in the formula below:

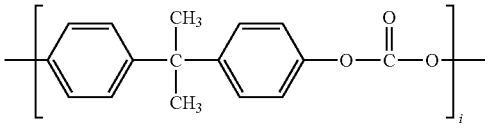

(bisphenol A polycarbonate)

wherein i indicates the degree of polymerization which is a positive integer of between 20 and about 80.

The charge transport layer 20 may have a Young's Modulus in the range of from about 2.5×10-5 psi (1.7×10-4 Kg/cm2) to about 4.5×10-5 psi (3.2×10-4 Kg/cm2) and a thermal contraction coefficient of between about 6×10-5° C. and about 8×10-5° C.

Since the charge transport layer 20 can have a substantially greater thermal contraction coefficient constant (3.7 times) compared to that of the support substrate 10, the prepared flexible electrophotographic imaging member (having a 29 micrometers charge transport layer) will typically exhibit spontaneous upward curling, into a 1½ inch roll if unrestrained, due to the result of larger dimensional contraction in the charge transport layer 20 than the support substrate 10, as the imaging member cools from the glass transition temperature of the charge transport layer down to room ambient temperature of 25° C. after the heating/drying processes of the applied wet charge transport layer coating. Therefore, internal tensile pulling strain is build-in in the charge transport layer and can be expressed in equation (1) below:

$$\in=(\alpha_{CTL}-\alpha_{sub})(Tg_{CTL}-25^\circ\text{ C.}) \quad (1)$$

wherein $\in$ is the internal strain build-in in the charge transport layer, $\alpha_{CTL}$ and $\alpha_{sub}$ are coefficient of thermal contraction of charge transport layer and substrate respectively, and $Tg_{CTL}$ is the glass transition temperature of the charge transport layer. Therefore, equation (1), had indicated that to suppress or control the imaging member upward curling, decreasing the $Tg_{CTL}$ of the charge transport layer is indeed the key to minimize the charge transport layer strain and impact the imaging member flatness.

An anticurl back coating 1 can be applied to the back side of the support substrate 10 (which is the side opposite the side bearing the electrically active coating layers) in order to render the prepared imaging member with desired flatness. That means for example, an anti-curl back coating 1 of about 17 micrometers is therefore needed and applied to the back side of the support substrate 10 to counteract against the effect of the 29-micrometer thick charge transport layer in order to fully control the curl and render the prepared imaging member with desired flatness.

The Anticurl Back Coating

Since the charge transport layer 20 is applied by solution coating process, the applied wet film is dried at elevated temperature and then subsequently cooled down to room ambient. The resulting imaging member web (comprising a 29 micrometers charge transport layer and a 3 mils PET substrate) if, at this point, not restrained, will spontaneously curl upwardly into a 1½ inch tube due to greater dimensional contraction and shrinkage of the Charge transport layer than that of the substrate support layer 10. An anti-curl back coating 1, as the conventional imaging member shown in FIG. 1, is then applied to the back side of the support substrate 10 (which is the side opposite the side bearing the electrically active coating layers) in order to render the prepared imaging member with desired flatness.

Generally, the anticurl back coating 1 comprises a thermoplastic polymer and an adhesion promoter. The thermoplastic polymer, in some embodiments being the same as the polymer binder used in the charge transport layer, is typically a bisphenol A polycarbonate, which along with the addition of an adhesion promoter of polyester are both dissolved in a solvent to form an anticurl back coating solution. The coated anticurl back coating 1 must adhere well to the support substrate 10 to prevent premature layer delamination during imaging member belt machine function in the field.

In a conventional anticurl back coating, an adhesion promoter of copolyester is included in the bisphenol A polycarbonate poly(4,4'-isopropylidene diphenyl carbonate) material matrix to provide adhesion bonding enhancement to the substrate support. Satisfactory adhesion promoter content is from about 0.2 percent to about 20 percent or from about 2 percent to about 10 percent by weight, based on the total weight of the anticurl back coating The adhesion promoter may be any known in the art, such as for example, VITEL PE2200 which is available from Bostik, Inc. (Middleton, Mass.). To counteract the pulling effect of a 29 micrometers charge transport layer, the anticurl back coating of 17 micrometers in thickness is needed to control imaging member upward curling and provide flatness. A typical, conventional anticurl back coating formulation has a 92:8 weight ratio of polycarbonate to adhesive.

Figure 2:
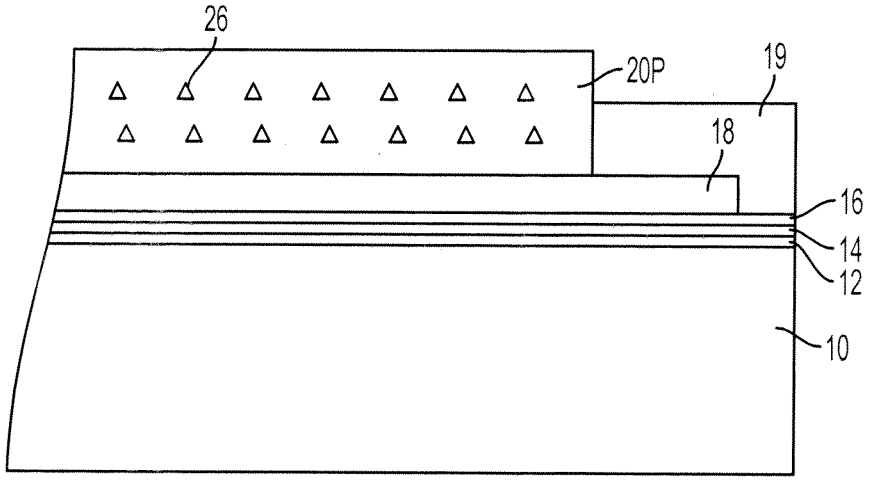
FIG. 2 is a cross-sectional view of a flexible multilayered electrophotographic imaging member having a plasticized single charge transport layer and being anticurl back coating-free according to an embodiment of the present disclosure.

FIG. 2 discloses a structurally simplified anticurl back coating-less flexible imaging member configuration prepared according to the material formulation and methodology of the present disclosure. In embodiments, the substrate 10, conductive ground plane 12, hole blocking layer 14, adhesive interface layer 16, charge generating layer 18, of the disclosed imaging member are prepared to have the same materials, compositions, thicknesses, and follow the identical procedures as those described in the conventional imaging member of FIG. 1, but with the exception that the charge transport layer 20 is reformulated to give an amine/ozone resistance as well as electrical cyclic stability, and charge transport layer internal stress/strain relief to suppress imaging member curl suppression. The reformulation includes a di-vinyl phthalate liquid 26 plasticizer of Formula (E) incorporation and becomes the charge transport layer 20P, to effect its internal strain reduction and render the resulting imaging member with desirable flatness without the need of the anticurl back coating. In essence, the presence of the plasticizer liquid in the layer material matrix, the Tg of the plasticized charge transport layer is therefore substantially depressed, such that the magnitude of (Tg−25° C.) becomes a small value to decrease charge transport layer internal strain, according to equation (1), and effect imaging member curling suppression. The reformulated charge transport layer 20P comprises an average of about 30% to about 70% weight of a diamine charge transporting compound such as mTBD (N,N'-diphenyl-N,N'-bis[3-methylphenyl]-[1,1'-biphenyl]-4,4'-diamine), about 70% to about 30% weight of polymer binder bisphenol A polycarbonate poly(4,4'-isopropylidene diphenyl carbonate).

FIG. 2 discloses a structurally simplified anticurl back coating-less flexible imaging member configuration prepared according to the material formulation and methodology of the present disclosure. That means the structurally simplified imaging member, having a plasticized charge transport layer 20P is prepared to give an amine/ozone resistance as well as electrical cyclic stability, and charge transport layer internal stress/strain relief to effect imaging member curl suppression without the need of an anticurl back coating. In embodiments, the substrate 10, conductive ground plane 12, hole blocking layer 14, adhesive interface layer 16, charge generating layer 18, of the disclosed anticurl back coating-less imaging member of FIG. 2 are prepared to have the same materials, compositions, thicknesses, and follow the identical procedures as those described in the conventional imaging member of FIG. 1, but with the exception that the conventional charge transport layer 20 is reformulated to give charge transport layer 20P which has amine/ozone resistance as well as electrical cyclic stability function, and charge transport layer internal stress/strain relief to suppress imaging member curl. This is achieved by substituting the bisphenol A polycarbonate binder in conventional charge transport layer by a film forming organic acid terminated A-B diblock copolymer binder and plus the incorporation of a high boiling liquid vinyl containing plasticizer 26 to give the resulting transport layer 20P (comprising charge transporting compound such as mTBD (N,N'-diphenyl-N,N'-bis[3-methylphenyl]-[1,1'-biphenyl]-4,4'-diamine), diblock copolymer, and a plasticizer) according to the method and process of this disclosure. Therefore, with the presence of plasticizer liquid 26 in the reformulated charge transport layer 20P material matrix, the Tg of the plasticized charge transport layer 20P is substantially depressed, such that the magnitude of (Tg−25° C.) becomes a small value to decrease charge transport layer 20P internal stress/strain, according to equation (1), and effect imaging member curling suppression and control to render imaging member flatness without anticurl back coating.

According to aspects illustrated herein, there is provided an anticurl back coating-less flexible imaging member shown in FIG. 2 comprising a flexible substrate 10, a conductive ground plane 12, a hole blocking layer, 14, an adhesive interface layer 16, a charge generating layer 18 disposed on the adhesive interface layer 16, a ground strip layer 16, and a plasticized charge transport layer 20P of present disclosure disposed on the charge generating layer 18 to effect imaging member control and render flatness. The charge transport layer 20P of this disclosure is a solid solution formulated to comprise a charge transport compound of N,N'-diphenyl-N,N'-bis(3-methylphenyl)-1,1-biphenyl-4,4'-diamine molecularly dispersed/dissolved in the A-B diblock copolymer and the plasticizer. The organic acid terminated A-B diblock copolymer used as binder in the plasticized charge transport layer 20P is a linear saturated diblock copolymer having a general Molecular Formula (I) representation shown in the following:

$$R_1-(-[\text{Block A}]_z-[\text{Block B}]_y-)_n-OH \qquad \text{Formula (I)}$$

wherein block A is a polycarbonate repeating unit, block B is an organic acid containing repeating unit, z represents the number of carbonate repeating units of block A and is, for example, from about 9 to about 18, from about 27 to about 36, or from about 45 to about 54, y represents the number of organic acid containing repeating units of block B and is, for example, from about 1 to about 6, or from about 1 to about 2, n represents the degree of polymerization of the A-B diblock copolymer, which can be between about 20 and about 80, between about 30 and about 70, or between about 40 and about 60, $R_1$ is H or $CH_3$. The copolymer typically has a weight average molecular weight of between about 80,000 and about 250,000 or between about 100,000 and about 200,000, or between about 110,000 and about 150,000.

The film forming A-B diblock copolymer of Formula (I) used binder in the plasticized charge transport layer 20P is derived from different types of polycarbonates by the inclusion of a small fraction from one of different dicarboxylic acids into the polymer backbone, resulting in a copolymer that contains from about 98 mole percent to about 80 mole percent, or from about 95 mole percent to about 85 mole percent of a carbonate segmental block A linearly linking to from about 2 mole percent to about 20 mole percent or from about 5 mole percent to about 15 mole percent of a segmental block B containing of a dicarboxylic acid terminal in the A-B diblock copolymer chain. In specific embodiments, the resulting copolymer contains about 90 mole percent of a segment block A linearly linking to about 10 mole percent of a segmental block B of an acid terminal in the A-B diblock copolymer chain.

The polycarbonate segment block A in the A-B diblock copolymer of Formula (I) has the following general Structure (A):

Structure (A)

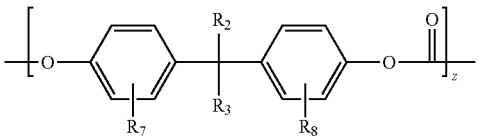

wherein each $R_2$, $R_3$ is independently H or lower $C_1$-$C_3$ alkyl, or $R_2$ and $R_3$ taken together with the C atom to which they are attached form an alkylcyclic ring, where any ring atom of the alkylcyclic ring may be optionally substituted with an alkyl; each $R_7$, $R_8$ is independently H or lower $C_1$-$C_3$ alkyl; and z is between about 9 and about 18, between about 27 and about 36, or between about 45 and about 54. In certain embodiments, each of $R_2$, $R_3$ is methyl, or $R_2$ and $R_3$ taken together with the C atom to which they are attached form a cyclohexane, where any ring atom of the cyclohexane may be optionally substituted with one or more methyl. In certain embodiments, each of $R_7$, $R_8$ is H or each of $R_7$, $R_8$ is methyl.

While the organic acid segment block B in the A-B diblock copolymer of Formula (I) has the following general Structure (B):

Structure (B)

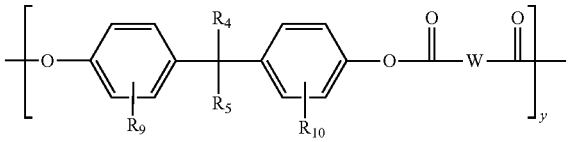

wherein each $R_4$, $R_5$ is independently H or lower $C_1$-$C_3$ alkyl, or $R_4$ and $R_5$ taken together with the C atom to which they are attached form an alkylcyclic ring, where any ring atom of the alkylcyclic ring may be optionally substituted with an alkyl; each $R_9$, $R_{10}$ is independently H or a lower $C_1$-$C_3$ alkyl; and y is between about 1 and about 2. In certain embodiments, each of $R_4$, $R_5$ is methyl, or $R_4$ and $R_5$ taken together with the C atom to which they are attached form a cyclohexane, where any ring atom of the cyclohexane may be optionally substituted with one or more methyl. In certain embodiments, each of $R_9$, $R_{10}$ is H or each of $R_9$, $R_{10}$ is methyl.

In specific embodiments, the film forming A-B diblock copolymer of Formula (I) used for polymer blended binder 24P is a polycarbonate derived from the bisphenol A polycarbonate by the inclusion of a small fraction of dicarboxylic acid to form a linear copolymer chain backbone; the resulting copolymer contains about 90 mole percent of a bisphenol A segment block A linearly linking to about 10 mole percent of a segmental block B of dicarboxylic acid terminal in the A-B diblock copolymer chain.

Exemplary polycarbonates (Block A) of the Structure (A) in the A-B diblock copolymer is a selection from one of the following carbonates:

Structure A-1

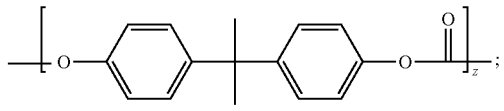

(bisphenol A polycarbonate)

Structure A-2

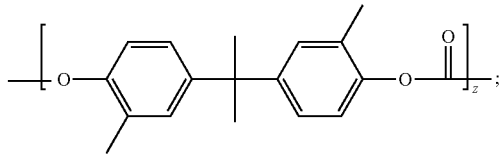

Structure A-3

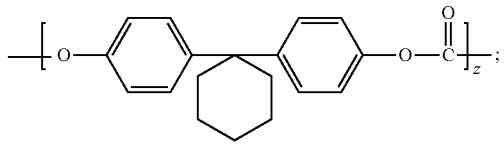

Structure A-4

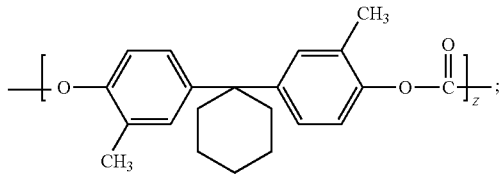

Structure A-5

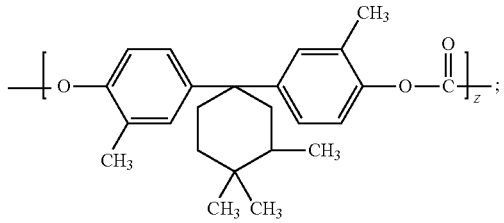

Structure A-6

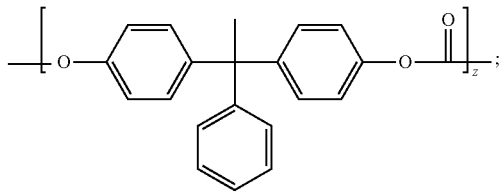

Structure A-7

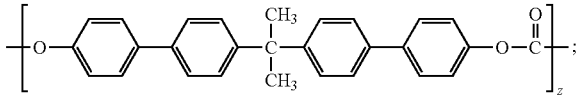

Structure A-8

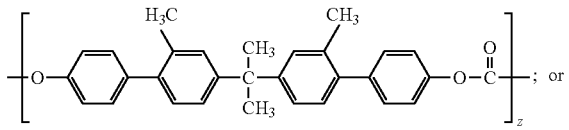

; or

-continued

Structure A-9

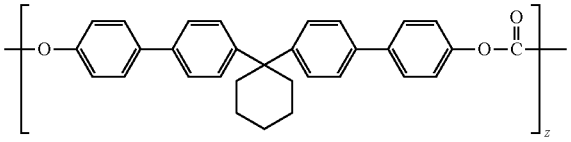

wherein z is an integer representing the numbers of repeating segmental carbonate unit, and is from about 9 to about 18, from about 27 to about 36, or from about 45 to about 54.

The exemplary example of organic acid terminal unit (Block B) of the Structure (B) in the A-B diblock copolymer has any of the following structures:

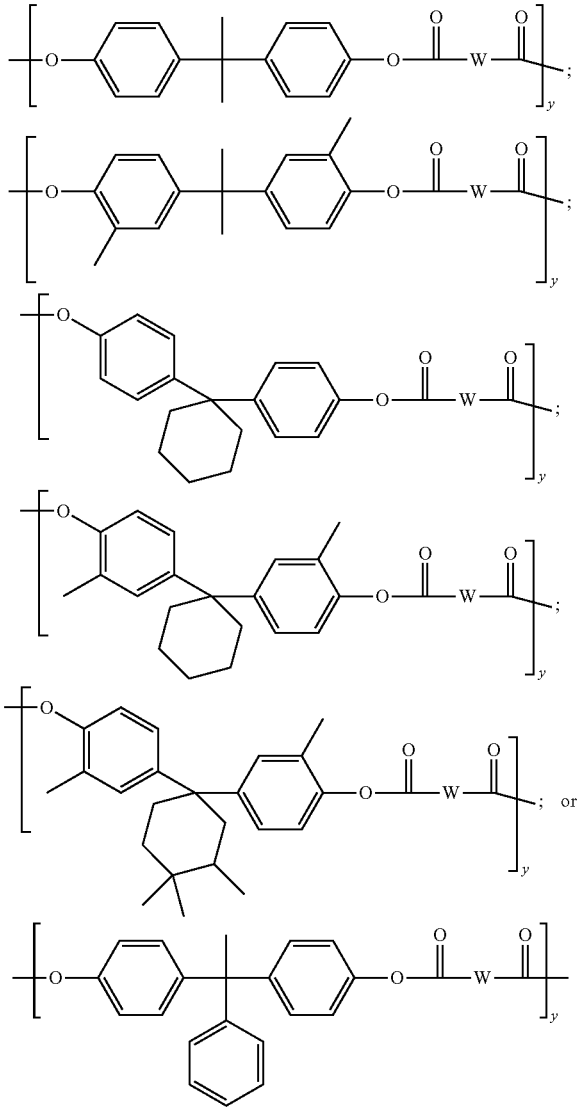

wherein W is an aromatic moiety or an aliphatic moiety, and y is from about 1 to about 6. In certain embodiments, W is an aryl having from 6 to 36 carbon atoms, or from 6 to 24. In certain of such embodiments, W is a phenyl. In certain embodiments, W is an alkylene having from 2 carbon atoms to 10 carbon atoms, from about 3 to about 8 carbons, or from 4 to 6 carbons.

Alternatively, the dicarboxylic acid terminal units (Block B) of Structure (B) in the SA-B diblock copolymer may also include the following structures:

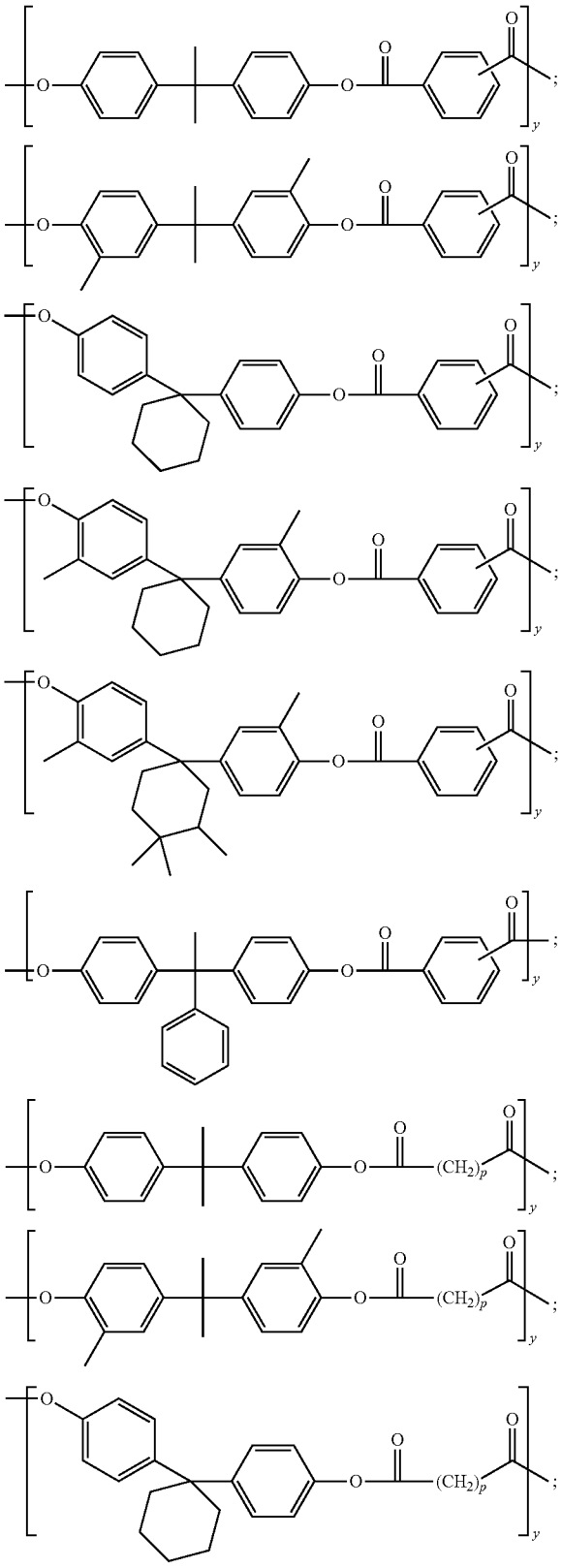

-continued
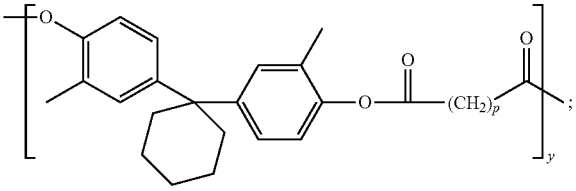
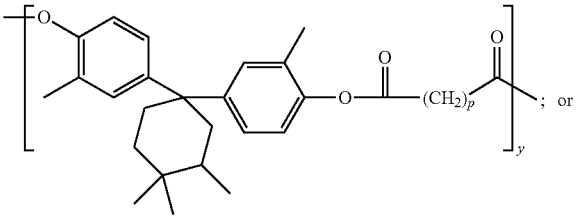
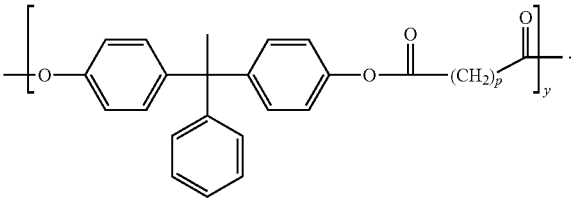
wherein p is from 3 to 8 or from 4 to 6; and y is from about 1 to about 6.
In yet certain of such embodiments, the dicarboxylic acid terminal units have the following structures:
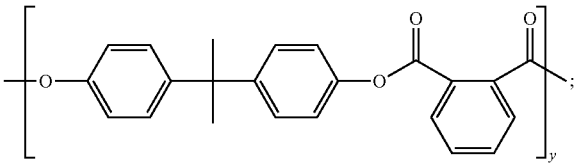
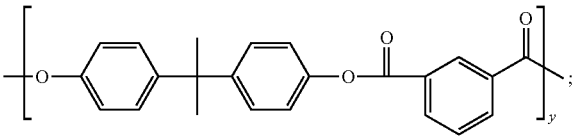
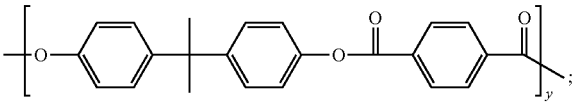
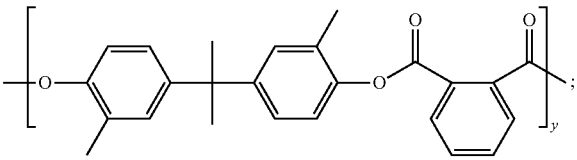
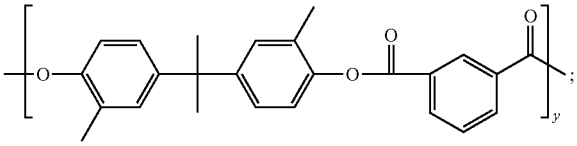
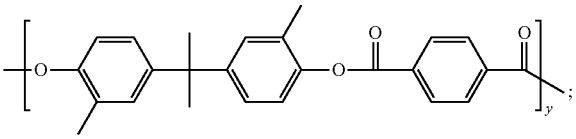
-continued
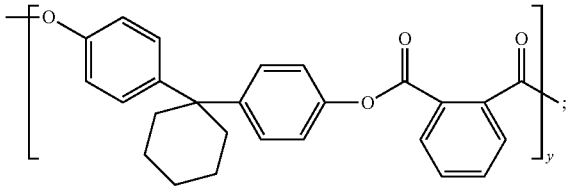
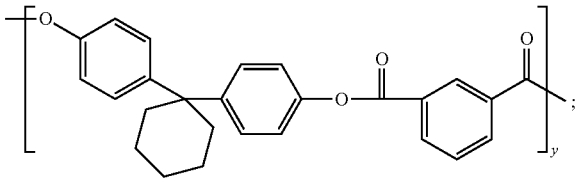
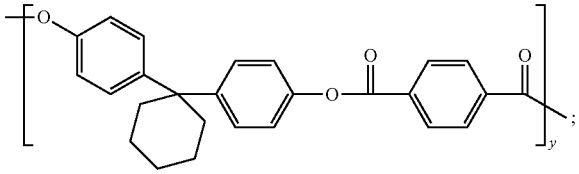
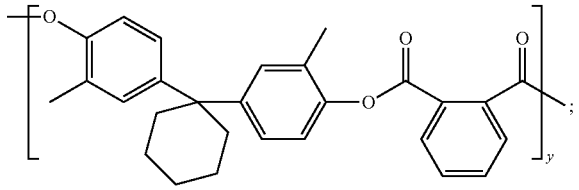
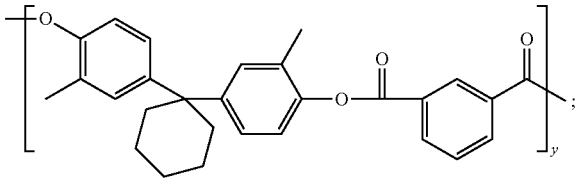
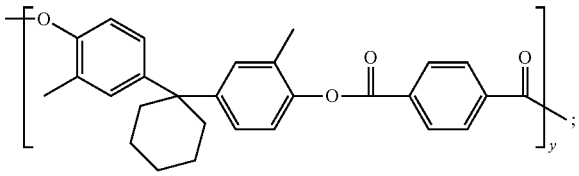
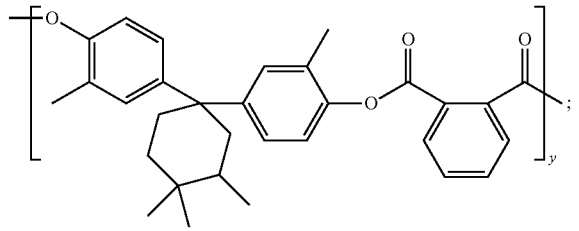
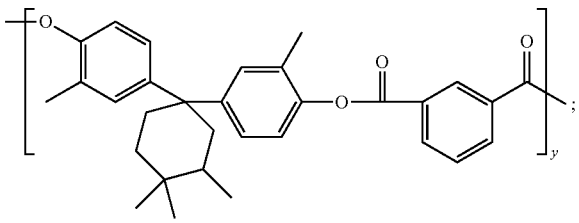

-continued
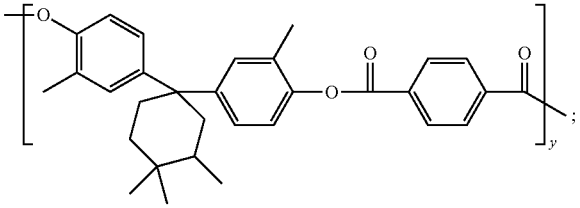
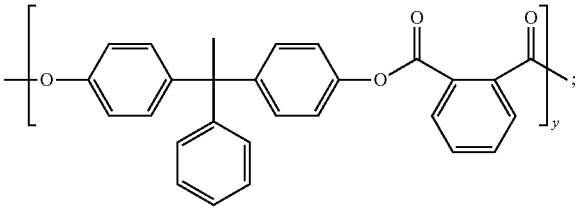
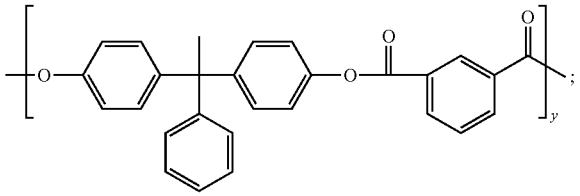
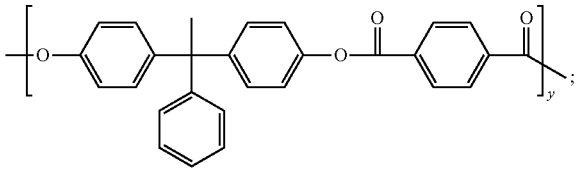
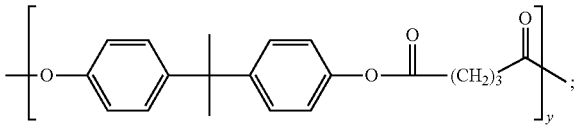
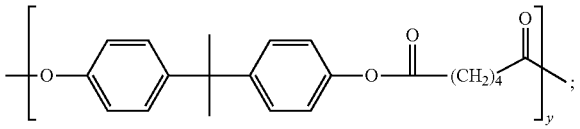
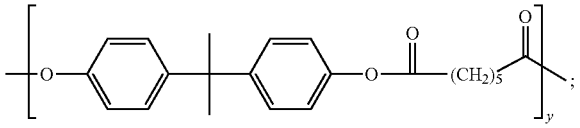
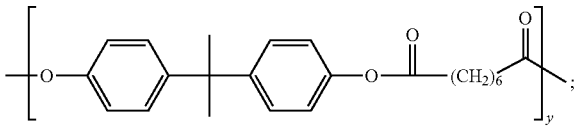
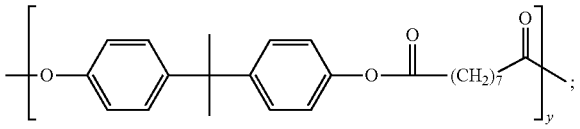
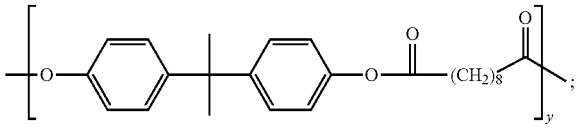
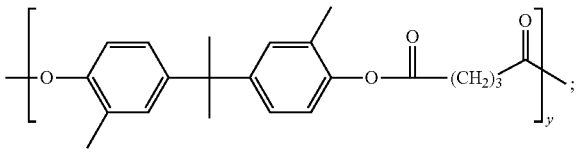
-continued
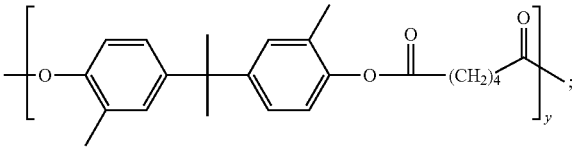
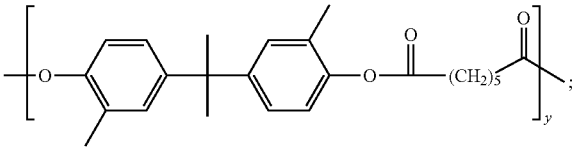
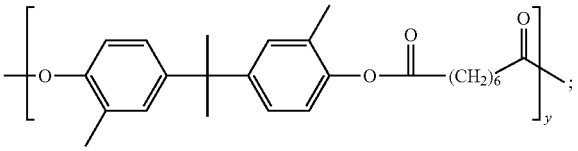
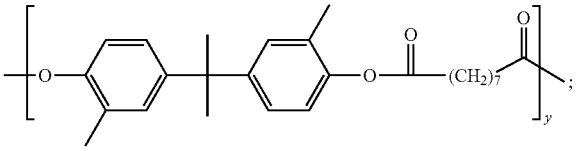
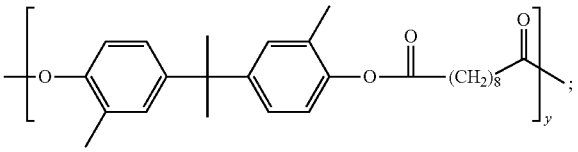
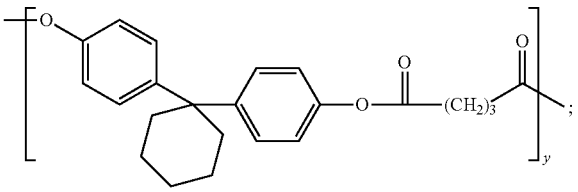
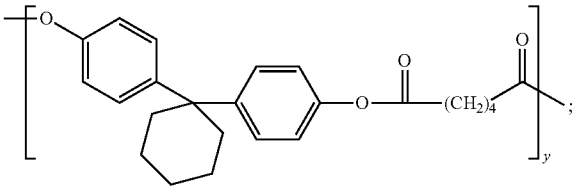
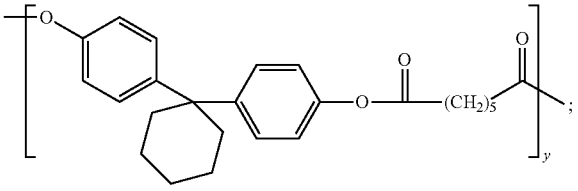
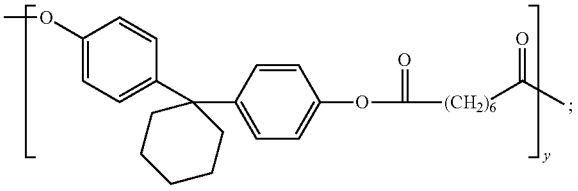
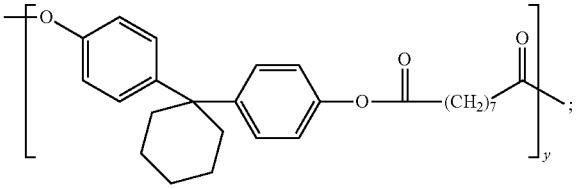

-continued
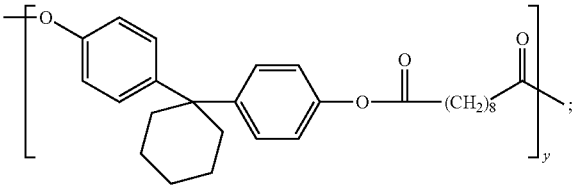
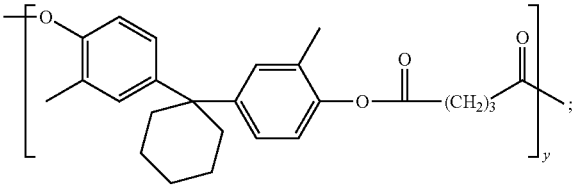
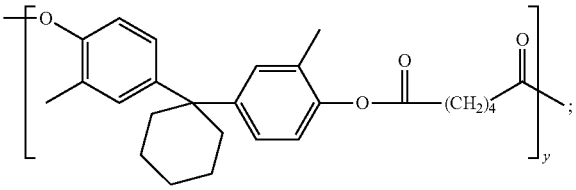
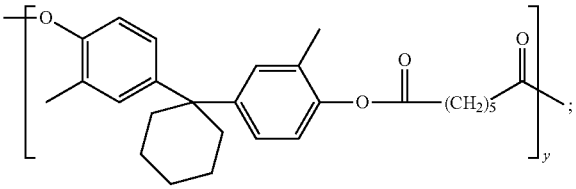
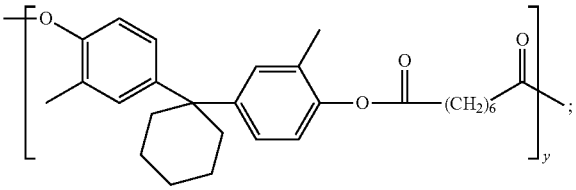
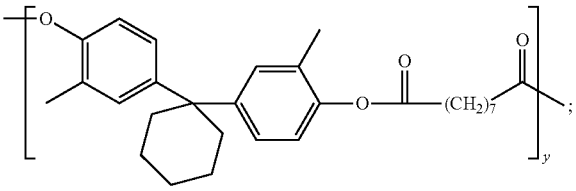
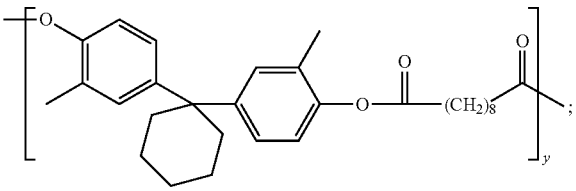
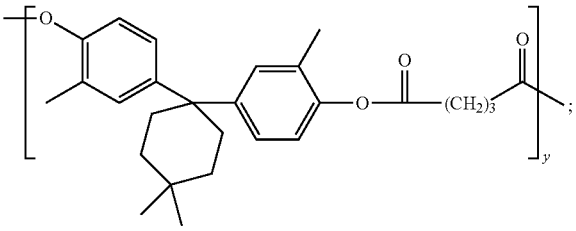
-continued
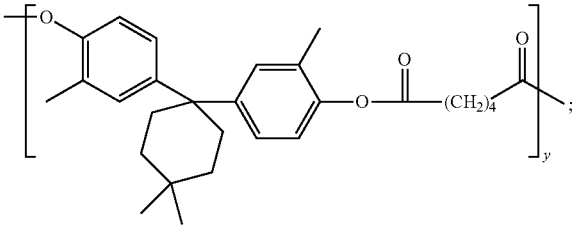
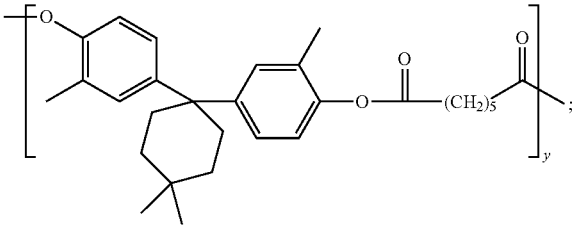
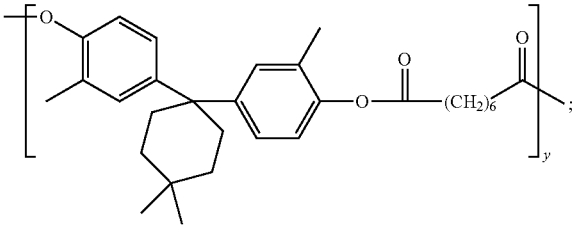
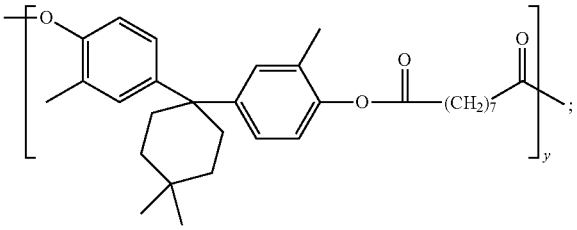
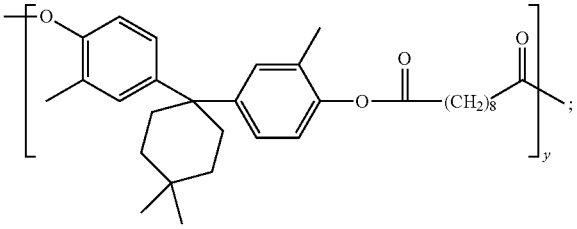
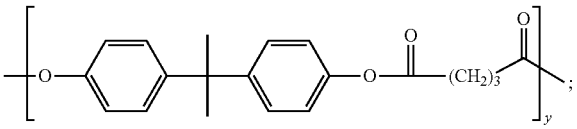
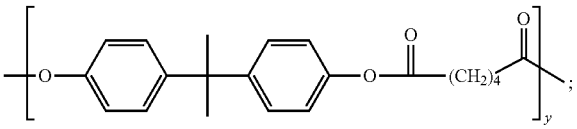
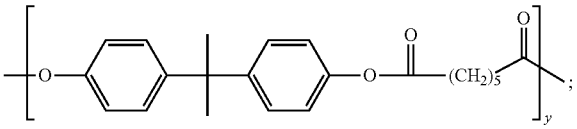
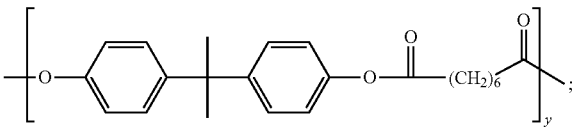

-continued

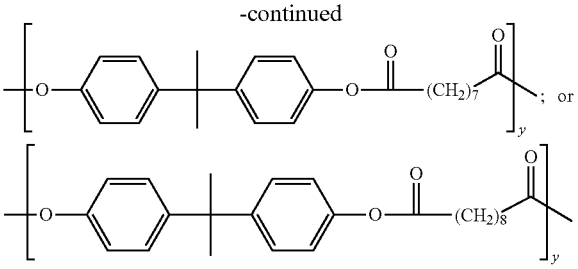

wherein y is 1 to 6.

In specific embodiments, the dicarboxylic acid segment in Block B may be derived from an aromatic dicarboxylic acid such as a phthalic acid, an terephthalic acid, an isophthalic acid, or derived from an aliphatic acid such as an glutaric acid, adipic acid, heptanedioic acid, octanedioic acid, azelaic acid, decanedioic acid, and the like as shown below:

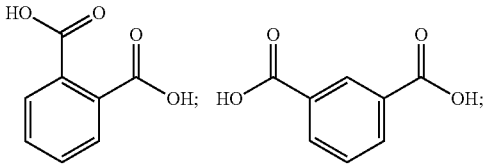

-continued

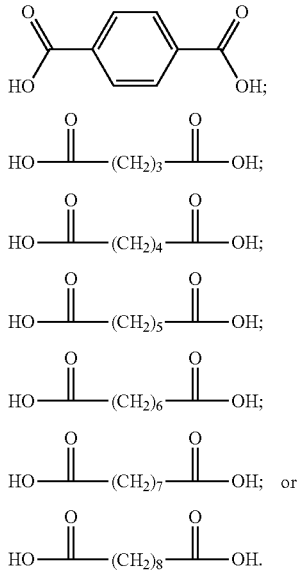

In certain embodiments, the A-B diblock copolymer has a structure of Formula II:

Formula II

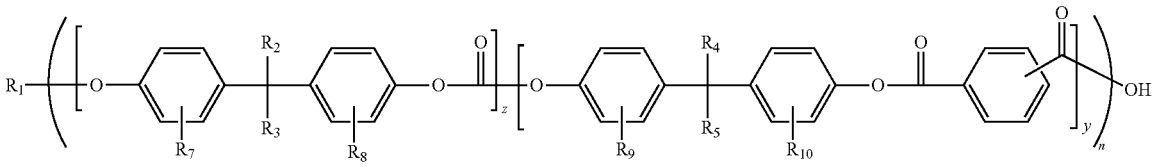

wherein the Block A and Block B are independently selected from the above lists.

In certain embodiments, the A-B diblock copolymer has a structure of Formula III:

Formula III

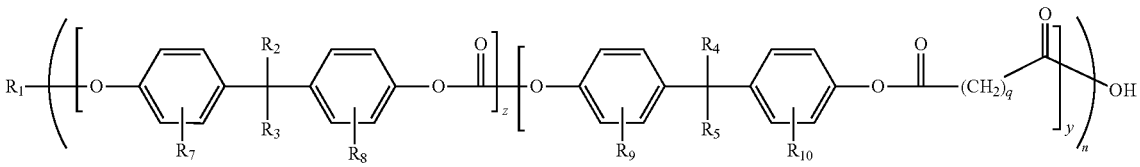

wherein the Block A and Block B are independently selected from the above lists. $R_1$ to $R_5$ and $R_7$ to $R_{10}$ are defined in the present embodiments discussed above.

In a very specific and particular embodiment, the anticurl back coating-less flexible imaging member of FIG. 2 comprises a flexible substrate 10, a conductive ground plane 12, a hole blocking layer, 14, an adhesive interface layer 16, a charge generating layer 18 disposed on the adhesive interface layer 16, a ground strip layer 16, and a plasticized charge transport layer 20P of present disclosure disposed on the charge generating layer 18 to render imaging member flatness. The plasticized charge transport layer 20P, prepared according to the method and process of this disclosure, is formulated to comprise of a charge transport compound of N,N'-diphenyl-N,N'-bis(3-methylphenyl)-1,1-biphenyl-4,4'-diamine which is molecularly dispersed/dissolved in a specifically selected film forming A-B diblock copolymer plus a vinyl containing plasticizer.

The specifically selected film forming A-B diblock copolymer (containing an organic phthalic acid terminal Block (B) linearly linking to a bisphenol A polycarbonate segmental block (A) in copolymer chain backbone) used for reformulating the charge transport layer disclosure has the molecular structure Formulas (1) and (2) representation below:

Formula (1)

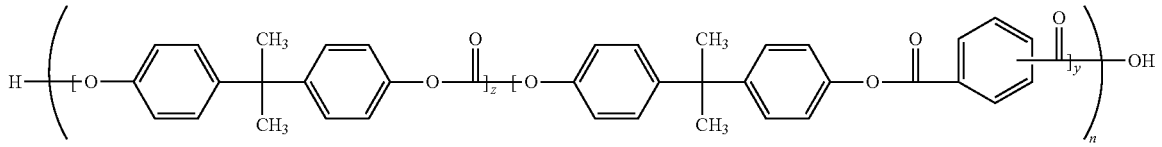

Block (A) Block (B)

Formula (2)

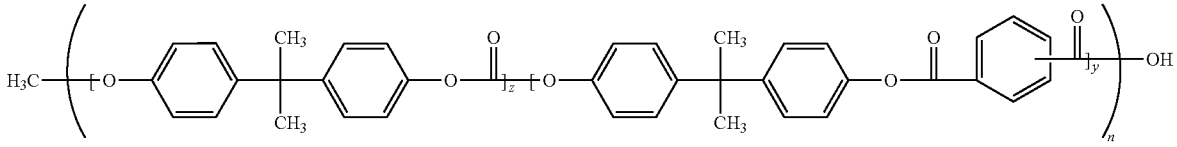

Block (A) Block (B)

wherein z represents the number of bisphenol A repeating units in segmental block (A) of from about 9 to about 18, y is number of repeating phthalic acid segmental block (B) of from about 1 to about 2, and n is the degree of polymerization between about 20 and about 90 for the copolymer having a high weight average molecular weight between about 100,000 and about 250,000 and mixtures thereof. It can be seen that the phthalic acid terminal in the A-B diblock copolymer of above Formulas (1) and (2) should provide the resulting plasticized charge transport layer 20P effective chemical amine protection by acid-base neutralization reaction. Furthermore, the linear linking of polycarbonate block (A) to the organic acid block (B) in the A-B diblock copolymer chain backbone can also produce an added benefit of effecting photoelectrical cyclic stability function to extend imaging member service life.

The ozone quenching plasticizer are vinyl-containing high boiling liquids selected from the group consisting of phthalates, carbonates, bisphenol carbonate monomers, and oligomeric styrenes.

The di-vinyl terephthalate plasticizers have the following general Formula (Ia) structures of:

Formula (Ia)

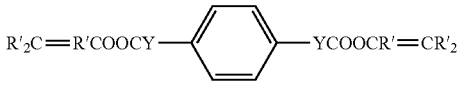

wherein Y is null, R' is H or F. In specific embodiments, the di-vinyl terephthalate liquid is selected from one of the group consisting of following structures of Formulas (A) and (B).

Formula (A)

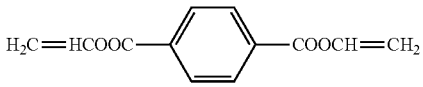

Formula (B)

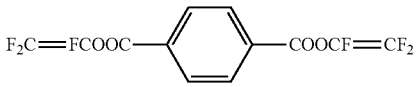

In formula (Ia), wherein Y is O and R' is H or F, the plasticizer liquid becomes a p-phenylene bis(vinyl carbonate) and has structural Formulas of (C) and (D):

Formula (C)

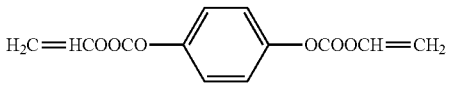

Formula (D)

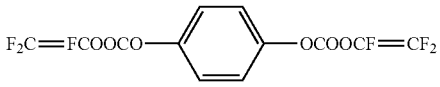

For an alternate liquid plasticizer selected for disclosure application, the following di-vinyl phthalate, having a general structural of Formula (Ib), may be used:

Formula (Ib)

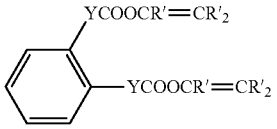

wherein Y is O or null, R' is H or F.

In another specific embodiment, another variance of di-vinyl phthalate liquid selected for plasticization (wherein Y is Y is null, R' is H or F in Formula (Ib)) includes any one or mixtures of the following Formulas (E) and (F), Formula (E)

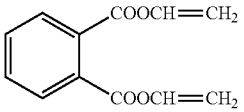

Formula (F)

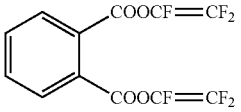

In Formula (Ib), wherein Y is O and R' is H or F, the plasticizer liquid has become an o-phenylene bis(vinyl carbonate) and has structural Formulas (G) and (H) of the following:

Formula (G)

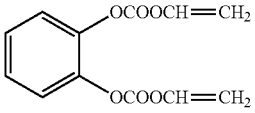

Formula (H)

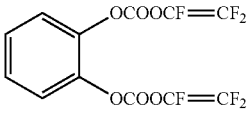

For yet another alternate liquid plasticizer included for charge transport layer incorporation, a variance of Formula (Ib) plasticizer, in which the two functional groups are rearranged to the 1, 3 positions attachment of benzene (as isophthalate) and give a general Formula (Ic) of below structure, is used:

Formula (Ic)

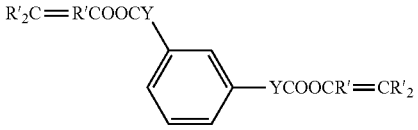

wherein Y is O or null, R' is H or F.

In still yet another specific embodiment, the phthalate liquid is a di-vinyl isophthalate (wherein y is null, R' is H or F of Formula (Ic)) which includes any one or mixtures of the following Formulas (J) and (K)

Formula (J)

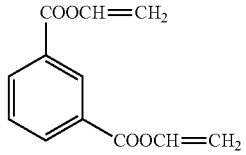

Formula (K)

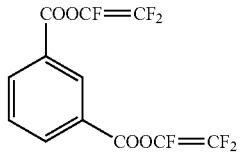

In formula (Ic), wherein Y is O and R' is H or F, the plasticizer liquid has become a m-phenylene bis(vinyl carbonate) and has structural Formulas (L) and (M) of the following:

Formula (L)

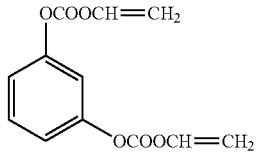

Formula (M)

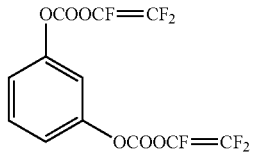

In still yet another embodiment, the plasticizer liquid is a di-vinyl bisphenol carbonate monomer selected from one of the group consisting of following structures of Formulas (A1), (A2), and (A3):

Formula (A1)

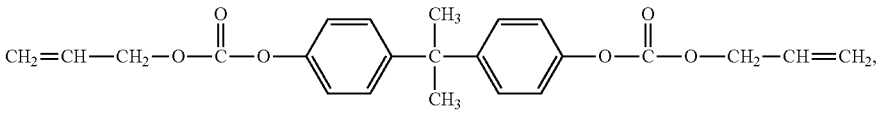

-continued

Formula (A2)

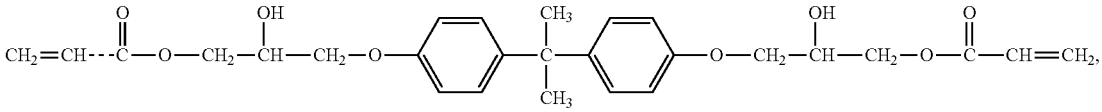

Formula (A3)

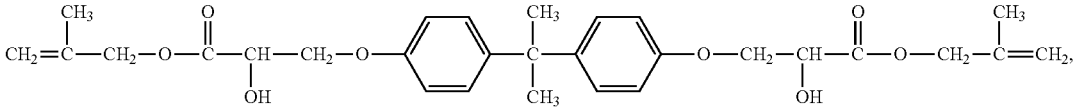

In still further yet another embodiment, the plasticizer liquid is vinyl and di-vinyl oligomeric styrenes selected from one of the group consisting of following structures of Formulas (A4) to (A6):

Formula (A4)

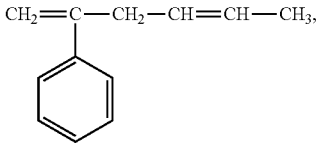

Formula (A5)

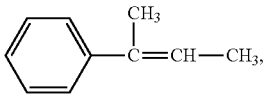

-continued

Formula (A6)

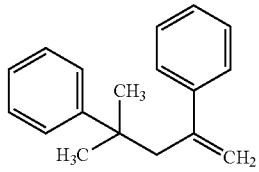

Other applicable liquid plasticizers include plasticizer liquids selected from the group consisting of following structures of Formulas (A7) to (A14):

Formula (A7)

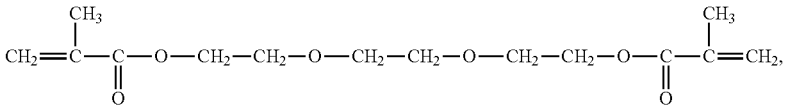

Formula (A8)

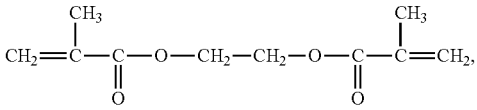

Formula (A9)

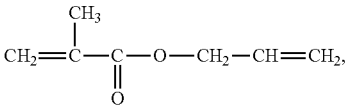

Formula (A10)

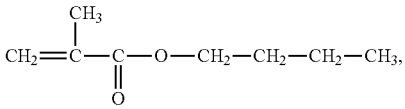

Formula (A11)

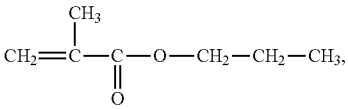

Formula (A12)

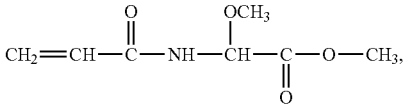

Formula (A13)

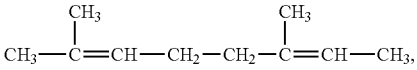

Formula (A14)

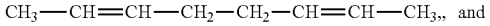

and and mixtures thereof.

Therefore, when incorporated into the charge transport layer reformulation of this disclosure, the benefit of providing anti-ozonant effect to suppress A-B diblock copolymer binder chain scission by ozone attack, was attributed to the vinyl or di-vinyl functional in the plasticizer incorporated into the reformulated charge transport layer material matrix. The mechanism of ozone quenching action provided by the vinyl functional group (—CH═$CH_2$) in the plasticizer is the key to rendering anti-ozonant protection which can be described by the following chemical reaction (taken from "PRINCIPLES OF POLYMER SYSTEMS" by Ferdinand Rodriguez; 4$^{TH}$ Edition, page 404; Taylor & Francis Publishers):

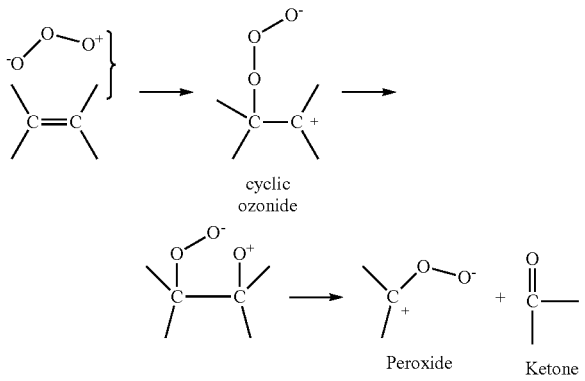

Furthermore, it is important to emphasize that all the above listed plasticizers selected for use in charge transport layer are compatible with the charge transport compound/diblock copolymer binder and have a boiling point of at least 250° C. to assure permanent presence for long term plasticizing effect.

In reference to FIG. 2, it is provided an anticurl back coating-less flexible imaging member comprising a substrate, a charge generating layer disposed on the substrate, and at least one charge transport layer disposed on the charge generating layer, wherein the charge transport layer comprises the diblock copolymer binder of Formulas (2) and (2), a charge transport compound of N,N'-diphenyl-N,N'-bis(3-methylphenyl)-1,1-biphenyl-4,4'-diamine, and an ozone quenching plasticizer, and further wherein the diblock copolymer, the ozone quenching plasticizer, and the charge transport compound N,N'-diphenyl-N,N'-bis(3-methylphenyl)-1,1-biphenyl-4,4'-diamine are compatible with each other to form a plasticized solid solution charge transport layer 20P. The amount of plasticizing liquid 26 in the charge transport layer 20P is in a range of from about 3 to about 30 weight percent or between about 10 and about 20 weight percent with respect to the total weight the of the reformulated charge transport layer 20P of this disclosure; and the weight ratio of charge transport compound to diblock copolymer is from about 30:70 to about 70:30 or from about 40:60 to about 60:40.

Figure 3:
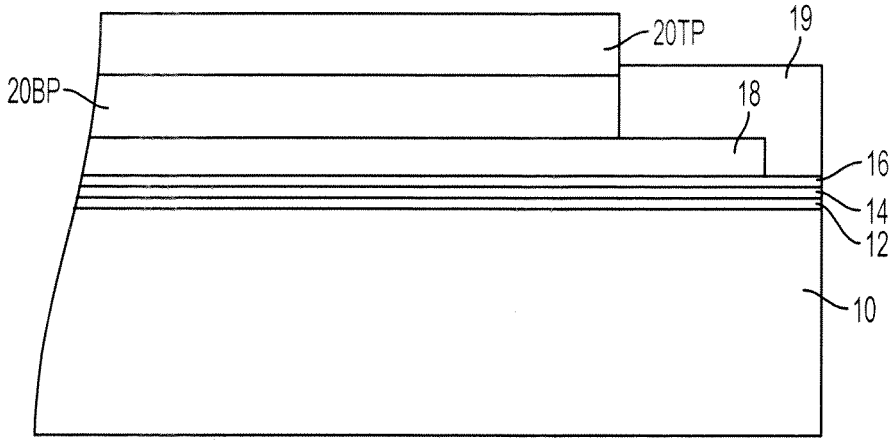
FIG. 3 is a cross-sectional view of a flexible multilayered electrophotographic imaging member having plasticized dual charge transport layers and being anticurl back coating-free according to an embodiment of the present disclosure.

According to the extended embodiment shown in FIG. 3, the charge transport layer 20P in the anticurl back coating-less flexible imaging member of FIG. 2 is redesigned to comprise liquid plasticized dual layers: a bottom (first) layer 20BP and a top (second) layer 20TP. Both of these layers comprise about the same thickness, same charge transport compound m-TBD, same A-B diblock copolymer, and same liquid plasticizer addition of from about 3 to about 30 weight percent or between about 10 and about 20 weight percent with respect to the total weight of the charge transport compound m-TBD, the A-B diblock copolymer, and the plasticizer presence in each respective layer. In the modification of these extended embodiments having liquid plasticized dual layers, they are again reformulated such that the bottom (first) layer 20BP contains larger amount of charge transport compound m-TBD than that in the top (second) 20TP layer; that means the first layer is comprised of about 50:50 to about 70:30 weight ratio of charge transport compound m-TBD to diblock copolymer, while the second layer comprises about 20:80 to about 30:70 weight ratio of charge transport compound m-TBD to diblock copolymer.

Figure 4:
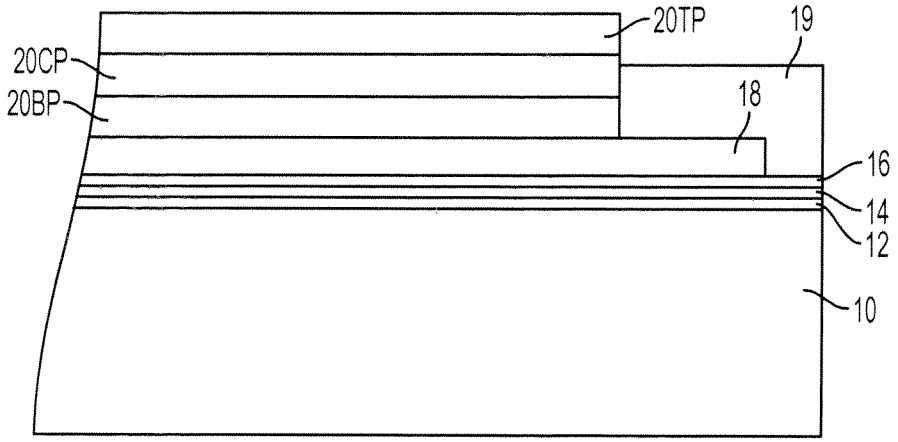
FIG. 4 is a cross-sectional view of a flexible multilayered electrophotographic imaging member having plasticized plasticized triple charge transport layers and being anticurl back coating-free according to an embodiment of the present disclosure.

The plasticized charge transport layer in the anticurl back coating-less flexible imaging members of the additionally extended embodiments, shown in FIG. 4, is further redesigned to give triple layers: a bottom (first) layer 20BP, a center (median) layer 20CP, and a top (outer) layer 20TP; all of which are plasticized with same plasticizer liquid. In these embodiments, all the triple layers comprise about same thickness, same charge transport compound m-TBD, same diblock copolymer composition matrix, and same amount of plasticizer liquid addition of from about 3 to about 30 weight percent or between about 10 and about 20 weight percent with respect to the summation weight the charge transport compound m-TBD, the diblock copolymer, and plasticizer in each respective layer. In the modification of these additionally extended embodiments, the liquid plasticized triple layers are again further reformulated to comprise different amount of charge transport compound m-TBD content, in descending order from bottom to the top layer, such that the weight ratio of charge transport compound m-TBD to diblock copolymer in the first layer is about 50:50 to about 80:20, the second layer is about 40:60 to about 50:50, and the third layer is about 20:80 to about 30:70.

Figure 5:
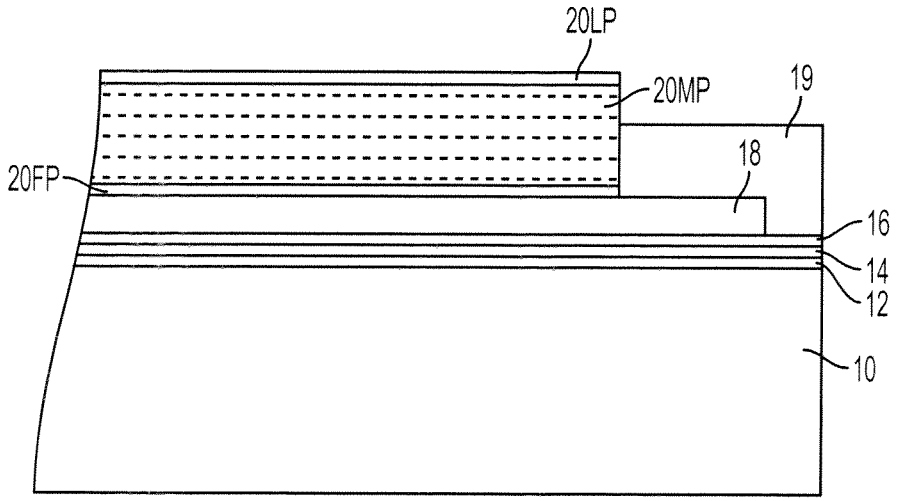
FIG. 5 is a cross-sectional view of a flexible multilayered electrophotographic imaging member having plasticized multiple charge transport layers and being anticurl back coating-free according to an embodiment of the present disclosure.

In further embodiments, the disclosed anticurl back coating-less flexible imaging member shown in FIG. 5 has plasticized multiple charge transport layers of having from about 4 to about 10 discreet layers, or between about 4 and about 6 discreet layers. These multiple layers are formed to have the same thickness, and consist of a first (bottom) layer 20FP, multiple (intermediate) layers 20MP, and a last (outermost) layer 20LP. All these layers comprise a diblock copolymer binder, same amount plasticizer liquid incorporation, and charge transport compound m-TBD content present in descending continuum order from bottom to the top layer such that the weight ratio of charge transport compound m-TBD to diblock copolymer in the bottom layer is about 50:50 to about 80:20, while the top layer is about 20:80 to about 30:70. The amount of plasticizer incorporation into these multiple layers is from about 3 to about 30 weight percent or between about 10 and about 20 weight percent with respect to the summation weight the charge transport compound m-TBD, diblock copolymer, and the plasticizer in each respective layer.

Figure 6:
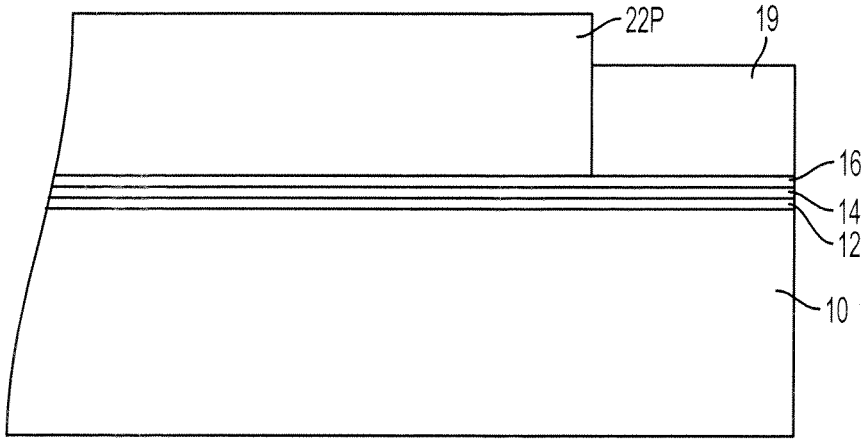
FIG. 6 is a cross-sectional view of a multilayered electrophotographic imaging member having a plasticized single charge generating/transporting layer and being anticurl back coating-free prepared according to an alternative embodiment of the present disclosure.

As an alternative to the two discretely separated layers of a charge transport 20 and a charge generation layers 18 as those described in FIG. 1, a structurally simplified flexible imaging member, having all other layers being formed in the same manners as described in preceding figures, may be created to contain a single imaging layer 22P having both charge generating and charge transporting capabilities and also being plasticized with the use of the present disclosed plasticizers to eliminate the need of an anticurl back coating according to the illustration shown in FIG. 6. The single imaging layer 22P may comprise a single electrophotographically active layer capable of retaining an electrostatic charge in the dark during electrostatic charging, imagewise exposure and image development, as disclosed, for example, in U.S. Pat. No. 6,756,169.

The single imaging layer 22P may be formed to include charge transport molecules in the A-B diblock copolymer binder, the same to those of the charge transport layer 20P previously described, and may also optionally include a photogenerating/photoconductive material similar to those of the layer 18 described above. In exemplary embodiments, the single imaging layer 22 of the structurally simplified and anticurl back coating-less flexible imaging member of this disclosure, shown in FIG. 6, is plasticized with a liquid of present disclosure selection. The amount of plasticizer incorporation into the layer 22 is from about 3 to about 30 weight percent or between about 10 and about 20 weight percent with respect to the summation weight the charge transport compound m-TBD, diblock copolymer, and the plasticizer in the layer.

Typically, the thickness of the plasticized single layer or plasticized dual, triple and multiple charge transport layer(s) of all the anticurl back coating-less imaging members, disclosed in FIGS. 2 to 6 above, is in the range of from about 10 to about 60 micrometers, or a thickness of from about 20 to about 40 micrometers. It is important to emphasize that the reasons the outermost top layer of imaging members employing compounded charge transport layers in the disclosure embodiments is formulated to comprise the least amount of charge transport compound m-TBD (in descending concentration gradient from the bottom layer to the top layer) are to: (1) inhibit charge transport compound m-TBD crystallization at the interface between two coating layers and (2) also to enhance the top layer's fatigue cracking resistance during dynamic machine imaging member belt cyclic function in the field.

In summary, the reformulated charge transport layer in all the anticurl back coating-less flexible imaging members detailed above is prepared, according to the descriptions of present disclosure, to comprise of a charge transport compound molecularly dispersed/dissolved in an A-B diblock copolymer binder and a vinyl containing plasticizer. The resulting anticurl back coating-less flexible imaging accordingly obtained has photoelectrical cyclic stability function, rendered chemical amine/ozone protection, enhanced charge transport layer cracking resistance, and provided adequate imaging member flatness without the need of an anticurl back coating. Therefore, the resulting anticurl back coating-less flexible imaging member of this disclosure effects service life extension in the field and cuts imaging member production cost as well.

The anticurl back coating-less flexible imaging members of present disclosure, prepared to contain a plasticized reformulated charge transport layer and without an anticurl backing layer, have improved photoelectrical stability function over the conventional imaging member control. That means having charge acceptance ($V_0$) in a range of from about 780 to about 820 volts; sensitivity (S) sensitivity from about 300 to about 400 volts/ergs/cm$^2$; residual potential (V) less than about 70 volts; potential after exposure and before development (Ve) from about 80 to about 100 volts; and dark decay voltage (Vdd) of between about 60 and about 20 volts. To further improve the disclosed anticurl back coating-less flexible imaging member design's mechanical performance, the plasticized top charge transport layer or single imaging layer, may also include the additive of inorganic or organic fillers to impart greater wear resistant enhancement. Inorganic fillers may include, but are not limited to, silica, metal oxides, metal carbonate, metal silicates, and the like. Examples of organic fillers include, but are not limited to, KEVLAR, stearates, fluorocarbon (PTFE) polymers such as POLYMIST and ZONYL, waxy polyethylene such as ACUMIST and ACRAWAX, fatty amides such as PETRAC erucamide, oleamide, and stearamide, and the like. Either micron-sized or nanosized inorganic or organic particles can be used in the fillers to achieve mechanical property reinforcement.

The anticurl back coating-less flexible multilayered electrophotographic imaging member fabricated in accordance with the embodiments of present disclosure, described in all the preceding, may be cut into rectangular sheets. A pair of opposite ends of each imaging member cut sheet is then brought overlapped together thereof and joined by any suitable means, such as ultrasonic welding, gluing, taping, stapling, or pressure and heat fusing to form a continuous imaging member seamed belt, sleeve, or cylinder.

An anticurl back coating-less flexible imaging belt of this disclosure may be used in any suitable and conventional electrophotographic imaging process which utilizes uniform surface charging prior to imagewise exposure to activating electromagnetic radiation. Therefore, when the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member. Thus, by applying a suitable electrical bias and selecting toner having the appropriate polarity of electrical charge, a toner image is formed in the charged areas or discharged areas on the imaging surface of the electrophotographic imaging member. For example, for positive development, charged toner particles are attracted to the oppositely charged electrostatic areas of the imaging surface and for reversal development, charged toner particles are attracted to the discharged areas of the imaging surface.

Furthermore, a prepared anticurl back coating-less flexible electrophotographic imaging member belt of this disclosure can additionally be evaluated by printing in a marking engine into which the belt, formed according to the exemplary embodiments, has been installed. For intrinsic electrical properties it can also be determined by conventional electrical drum scanners. Additionally, the assessment of its propensity of developing streak line defects print out in copies can alternatively be carried out by using electrical analyzing techniques, such as those disclosed in U.S. Pat. Nos. 5,703,487; 5,697,024; 6,008,653; 6,119,536; and 6,150,824, which are incorporated herein in their entireties by reference. All the patents and applications referred to herein are hereby specifically, and totally incorporated herein by reference in their entirety in the instant specification.

All the exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

EXAMPLES

The development of the presently disclosed embodiments will further be demonstrated in the non-limited Working Examples below. They are, therefore in all respects, to be considered as illustrative and not restrictive nor limited to the materials, conditions, process parameters, and the like recited herein. The scope of embodiments is being indicated by the appended claims rather than the foregoing description. All changes that come within the meaning of and range of equivalency of the claims are intended to be embraced therein. All proportions are by weight unless otherwise indicated. It will be apparent, however, that the present embodiments can be practiced with many types of compositions and can have many different uses in accordance with the disclosure above and as pointed out hereinafter.

Control Imaging Member Example

A conventional flexible electrophotographic imaging member web, as shown in FIG. 1, was prepared by providing a 0.02 micrometer thick titanium layer coated on a substrate of a biaxially oriented polyethylene naphthalate substrate (KADALEX, available from DuPont Teijin Films) having a thickness of 3.5 mils (89 micrometers). The titanized KADALEX substrate was extrusion coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and form a crosslinked silane blocking layer. The resulting blocking layer had an average dry thickness of 0.04 micrometers as measured with an ellipsometer.

An adhesive interface layer was then extrusion coated by applying to the blocking layer a wet coating containing 5 percent by weight based on the total weight of the solution of polyester adhesive (MOR-ESTER 49,000, available from Morton International, Inc.) in a 70:30 (v/v) mixture of tetrahydrofuran/cyclohexanone. The resulting adhesive interface layer, after passing through an oven, had a dry thickness of 0.095 micrometers.

The adhesive interface layer was thereafter coated over with a charge generating layer. The charge generating layer dispersion was prepared by adding 1.5 gram of polystyrene-co-4-vinyl pyridine and 44.33 gm of toluene into a 4 ounce glass bottle. 1.5 grams of hydroxygallium phthalocyanine Type V and 300 grams of ⅛-inch (3.2 millimeters) diameter stainless steel shot were added to the solution. This mixture was then placed on a ball mill for about 8 to about 20 hours. The resulting slurry was thereafter coated onto the adhesive interface by extrusion application process to form a layer having a wet thickness of 0.25 mils. However, a strip of about 10 millimeters wide along one edge of the substrate web stock bearing the blocking layer and the adhesive layer was deliberately left uncoated by the charge generating layer to facilitate adequate electrical contact by a ground strip layer to be applied later. The wet charge generating layer was dried at 125° C. for 2 minutes in a forced air oven to form a dry charge generating layer having a thickness of 0.4 micrometers.

This coated web stock was simultaneously coated over with a charge transport layer and a ground strip layer by co-extrusion of the two coating solutions. The charge transport layer was prepared by combining a bisphenol A polycarbonate thermoplastic having a molecular weight of about 120,000, commercially available from Mitsubishi Chemicals as FPC 170, with a charge transport compound N,N'-diphenyl-N,N'-bis(3-methylphenyl)-[1,1'-biphenyl]-4,4'-diamine in an amber glass bottle in a weight ratio of 1:1 (or 50 weight percent of each). The resulting mixture was dissolved to give 15 percent by weight solid in methylene chloride and was applied onto the charge generating layer along with a ground strip layer during the co-extrusion coating process.

The strip, about 10 millimeters wide, of the adhesive layer left uncoated by the charge generating layer, was coated with a ground strip layer during the co-extrusion of charge transport layer and ground strip coating. The ground strip layer coating mixture was prepared by combining 23.81 grams of polycarbonate resin (MAKROLON 5705, 7.87 percent by total weight solids, available from Bayer A.G.), and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose and 87.7 parts by weight of solvent (Acheson Graphite dispersion RW22790, available from Acheson Colloids Company) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion coating along with the charge transport layer, to the electrophotographic imaging member web to form an electrically conductive ground strip layer.

The imaging member web stock containing all of the above layers was then transported at 60 feet per minute web speed and passed through 125° C. production coater forced air oven to dry the co-extrusion coated ground strip and charge transport layer simultaneously to give respective 19 micrometers and 29 micrometers in dried thicknesses. At this point, the imaging member, having all the dried coating layers, would spontaneously curl upwardly into a 1.5-inch tube when unrestrained as the web was cooled down to room ambient of 25° C. Since the charge transport layer, having a glass transition temperature (Tg) of 85° C. and a coefficient of thermal contraction of about $6.6\times10^{-5}$/° C., it had about 3.7 times greater dimensional contraction than that of the PEN substrate having lesser a thermal contraction of about $1.9\times10^{-5}$/° C. Therefore, according to equation (1), a 2.75% internal strain was built-up in the charge transport layer to result in imaging member upward curling.

An anticurl coating was prepared by combining 88.2 grams of bisphenol A polycarbonate resin (FPC 170), 7.12 grams VITEL PE-2200 copolyester (available from Bostik, Inc. Middleton, Mass.) and 1,071 grams of methylene chloride in a carboy container to form a coating solution containing 8.9 percent solids. The container was covered tightly and placed on a roll mill for about 24 hours until the polycarbonate and polyester were dissolved in the methylene chloride to form the anti-curl back coating solution. The anticurl back coating solution was then applied to the rear surface (side opposite the charge generating layer and charge transport layer) of the electrophotographic imaging member web by extrusion coating and dried to a maximum temperature of 125° C. in the forced air oven to produce a dried anticurl backing layer having a thickness of 17 micrometers and flatten the imaging member. The resulting imaging member, prepared according to conventional prior art is shown in FIG. 1, was to be used as a control.

Disclosure Imaging Member Example I

Two flexible electrophotographic imaging member webs were then prepared by using the same material compositions and following identical procedures as described in the Control Imaging Member Example above, but with the exception that the FPC 170 bisphenol A polycarbonate binder in the charge transport layer was replaced by a novel A-B diblock copolymer LEXAN HLX (available from Sabic Innovative Plastics) and respectively incorporated with 5 and 8 weight percent of bisphenol A diacrylate (BPADA) plasticizer, based on the total weight of the reformulated plasticized charge transport layer of this disclosure. The two resulting imaging member webs as obtained were structurally simplified configuration without the application of an anticurl back coating and had reasonable flatness as that shown in FIG. 2. The LEXAN HLX A-B diblock copolymer has molecular structures shown in formulas representation below:

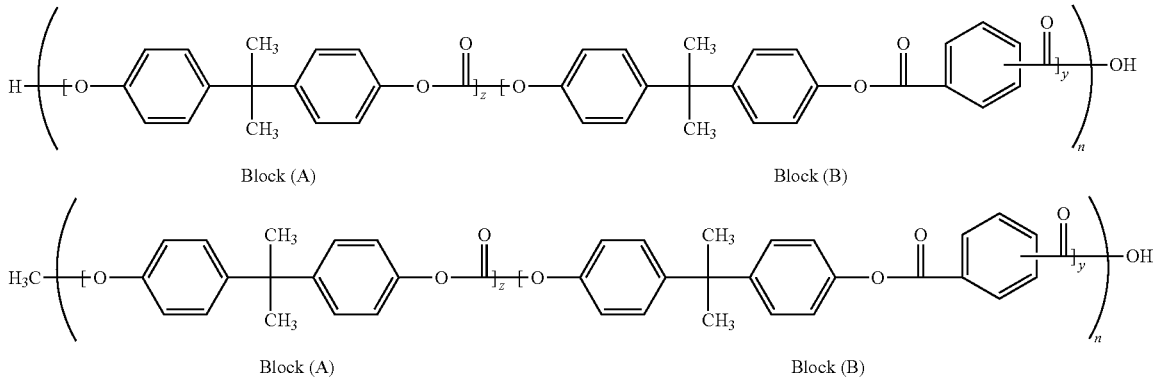

While the bisphenol A diacrylate (BPADA) plasticizer has the formula of:

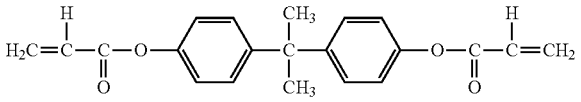

Disclosure Imaging Member Example II

Another two flexible electrophotographic imaging member webs were subsequently and likewisely prepared in the same material composition and procedures according to the description in the preceding Disclosure Imaging. Member Example I, except that the bisphenol A diacrylate (BPADA) were then substituted with 5 and 8 weight percent tetraethylene glycol dimethylacrylate (TEGDMA) plasticizer, based on the total weight of the reformulated plasticized charge transport layer of this disclosure. The two resulting imaging member webs thus obtained had structurally simplified configuration with reasonable flatness without the application of an anticurl back coating as that shown in FIG. 2. The tetraethylene glycol dimethylacrylate (TEGDMA) plasticizer has the following formula:

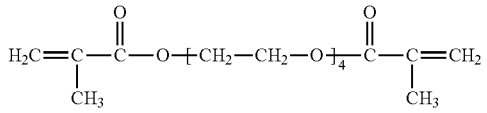

Ozone Exposure and Fatigue Cracking Test/Evaluation

A 2 inch×12 inch imaging member test sample was cut out from the Control Imaging Member Example and also from one of the Disclosure Imaging Member Example I having the 8% wt bisphenol A diacrylate (BPADA) liquid plasticized charge transport layer counterpart. The two cut piece test samples were each subjected to an ozone exposure test Corona effluents were generated by turning on a charging device in an enclosed large glass tubing operated under 700 micro-amperes and 8 KV conditions. The corona effluent exposure test was accomplished by placing both test samples inside the enclosed glass tube and simultaneously exposing them to the gaseous effluents generated by the charging device for 6 hours to induce ozone attack polycarbonate degradation. The aim of this experimental exposure test was to determine the impact of ozone attack on the charge transport layer mechanical degradation in the control imaging member and the effectiveness of the —CH═$CH_2$ (vinyl) terminal groups in ozone quenching plasticizer incorporation into the charge transport layer of imaging member of this disclosure. The observed anti-ozonant effect, to suppress polycarbonate binder chain degradation by ozone attack, was attributed to the vinyl containing liquid plasticizer presence in the charge transport layer. The mechanism of ozone quenching capability provided by the vinyl functional, —CH═$CH_2$, in the plasticizer can be described by the following chemical reaction:

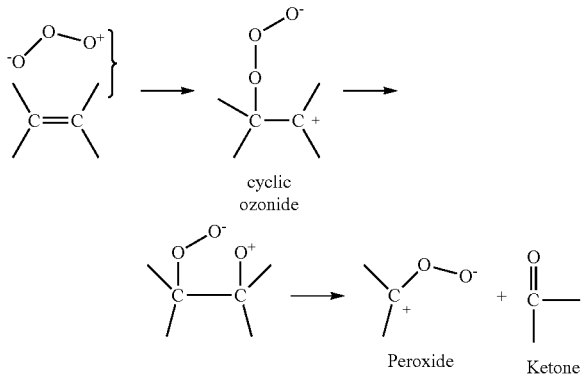

Dynamic fatigue bend flexing test were subsequently followed up and carried out respectively for each of these two imaging member samples (the disclosed and control samples) after ozone exposure test over one inch diameter roller, for up to 100 thousand fatigue bending flexes. Microscopy examination of these fatigue tested samples, under 100× magnification, showed that the conventional charge transport layer of the control imaging member developed substantial fatigue-bend cracking, while the plasticized charge transport layer of the disclosure imaging member counterpart (protected by the BPADA liquid plasticizer) was crack free.

Photoelectrical and Physical/Mechanical Determinations

The photoelectrical properties of the imaging members of the above Disclosure Examples were determined along the with imaging member of the Example Control by using the lab. 4000 scanner at constant current test. The measurement results thus obtained (shown in Table 1 below) have indicated that imaging members prepared to have plasticized charge transport layer re-design by using A-B diblock copolymer binder and incorporation of BPADA or TEDDMA liquid according to this disclosure could provide improved photoelectrical stability function compared to that seen in imaging member control counterpart containing a conventional charge transport layer formulation.

TABLE 1

| Test Sample ID | Plasticizer Content (%) | $V_0$ | S | $V_c$ | $V_r$ | $V_{e-6.0}$ | $V_{depl}$ | $V_{dd}$ (1-2 sec) |
|---|---|---|---|---|---|---|---|---|
| CONTROL | None | 799.2 | 350 | 159.6 | 29.1 | 44.7 | 56.0 | −34.1 |
| Disclosure I | 5% BPADA | 799.3 | 352 | 159.8 | 23.4 | 42.8 | 56.4 | −30.1 |
| Disclosure I | 8% BPADA | 799.3 | 358 | 162.2 | 26.1 | 44.3 | 59.1 | −29.6 |
| Disclosure II | 5% BPADA | 799.0 | 352 | 167.1 | 28.4 | 45.8 | 66.4 | −39.1 |
| Disclosure II | 8% BPADA | 799.1 | 348 | 167.0 | 30.3 | 46.4 | 69.2 | −42.3 |
| After 10K Cycles | | | | | | | | |
| CONTROL | None | 799.1 | 329 | 191.5 | 57.4 | 69.1 | 106.0 | −48.4 |
| Disclosure I | 5% BPADA | 799.0 | 338 | 197.7 | 43.8 | 71.2 | 105.3 | −52.6 |
| Disclosure I | 8% BPADA | 799.5 | 354 | 202.4 | 49.2 | 74.0 | 112.1 | −55.4 |
| Disclosure II | 5% BPADA | 799.0 | 336 | 202.1 | 51.7 | 75.8 | 119.0 | −59.6 |
| Disclosure II | 8% BPADA | 799.0 | 328 | 206.0 | 59.7 | 76.4 | 120.2 | −62.1 |

It is worth mentioning that even though plasticizer incorporation into the charge transport layer, ether using BPADA or TEDDMA liquid, could produce Tg depression of the resulting plasticized charge transport layer, Tg depression to 72° C. at 8 weight percent plasticizer loading level in the plasticized charge transport layer of the anticurl back coating-less flexible imaging member is still so much higher than the typical xerographic imaging machine operation temperature of about 40° C. in the field to cause functional problem.

Additionally, plasticizing the charge transport layer in the test loading levels disclosed in both Disclosure Examples disclosed above, were all found to give good layer adhesion bonding result greater than the adhesion specification value for imaging member to assure without the possibility of layer delamination during imaging member belt dynamic fatigue machine function in the field.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A flexible imaging member comprising:

a flexible substrate;

a charge generating layer disposed on a first side of the substrate; and at least one plasticized charge transport layer disposed on the charge generating layer, wherein the plasticized charge transport layer comprises a charge transport compound molecularly dispersed or dissolved in an A-B diblock copolymer binder and a plasticizer to form a solid solution, the A-B diblock copolymer binder comprising a bisphenol polycarbonate block (A) and an organic acid containing block (B) and having a general formula of $$R_1-(-[\text{Block A}]_z-[\text{Block B}]_y-)_n-OH$$

wherein block (A) is a polycarbonate repeating unit, block (B) is an organic acid containing repeating unit, z is from about 9 to about 54, y is from about 1 to about 6, n is between about 20 and about 80, and $R_1$ is H or $CH_3$, and further wherein the plasticizer in the plasticized charge transport layer is selected from the group consisting of Formula (A2)

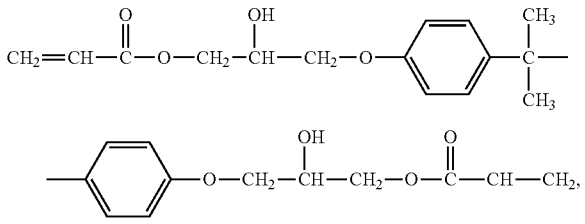

Formula (A3)

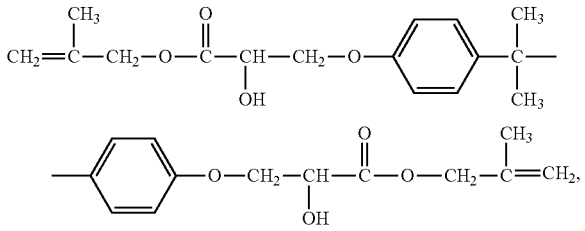

Formula (A4)

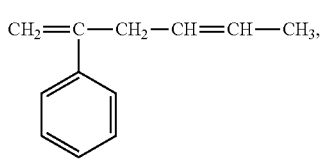

Formula (A5)

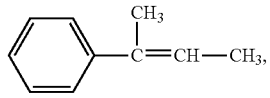

-continued

Formula (A8)

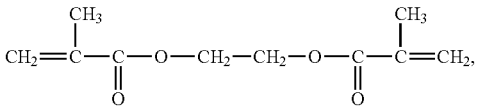

Formula (A9)

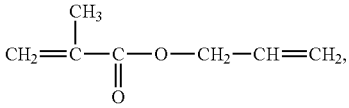

Formula (A10)

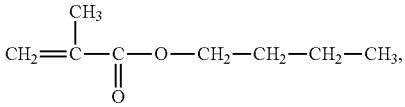

Formula (A11)

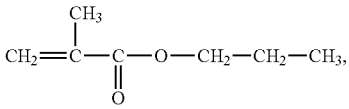

Formula (A12)

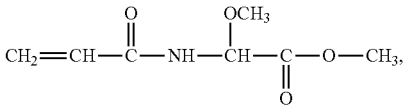

Formula (A13)

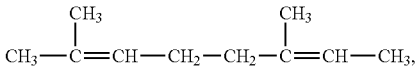

Formula (A14)

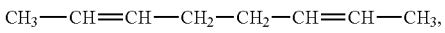

and mixtures thereof.

2. The flexible imaging member of claim 1, wherein the charge transport compound is N,N'-diphenyl-N,N'-bis(3-methylphenyl)-1,1'-biphenyl-4,4'-diamine (m-TBD).

3. The flexible imaging member of claim 1, wherein the vinyl-containing plasticizer has a high boiling point of at least 250° C.

4. The flexible imaging member of claim 1, wherein the vinyl-containing plasticizer is present in an amount of from about 3 to about 30 weight percent with respect to the total weight of the charge transport layer.

5. The flexible imaging member of claim 1, wherein a weight ratio of charge transport compound to diblock copolymer in the plasticized charge transport layer is from about 30:70 to about 70:30.

6. The flexible imaging member of claim 1, wherein the block (A) polycarbonate repeating unit in the A-B diblock copolymer is a bisphenol polycarbonate selected from the group consisting of Formula A-1

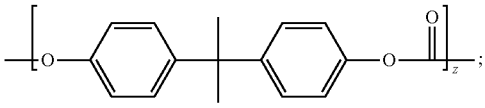

-continued

Formula A-2

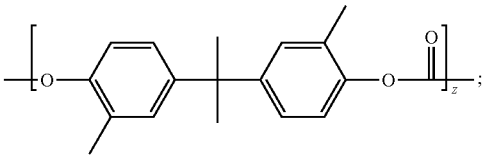

Formula A-3

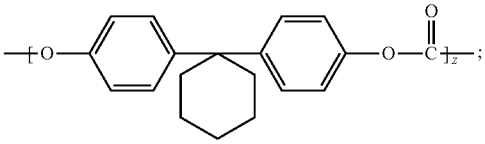

Formula A-4

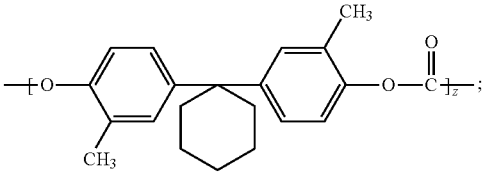

Formula A-5

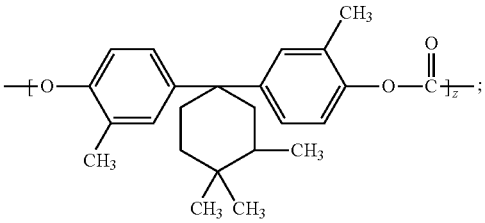

Formula A-6

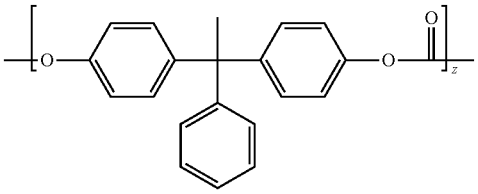

Formula A-7

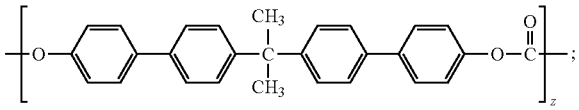

Formula A-8

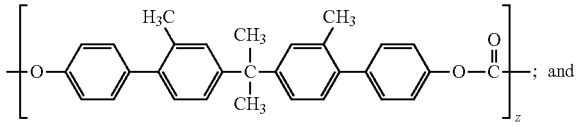

Formula A-9

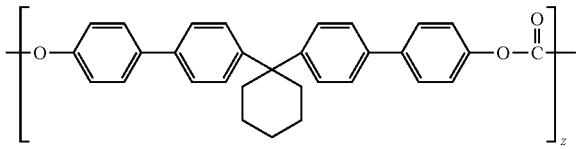

wherein z is an integer representing the numbers of repeating segmental carbonate unit, and is from about 9 to about 18, from about 27 to about 36, or from about 45 to about 54.

7. The flexible imaging member of claim 1, wherein the block (B) organic acid containing repeating unit in the A-B diblock copolymer is selected from the group consisting of:

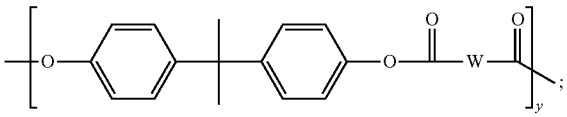

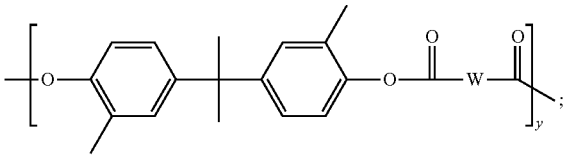

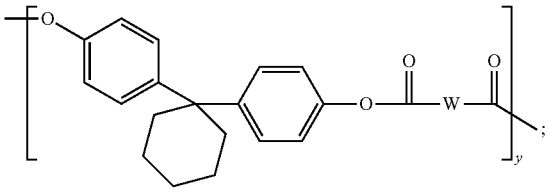

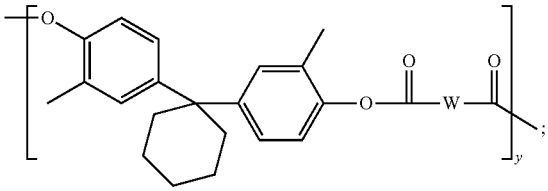

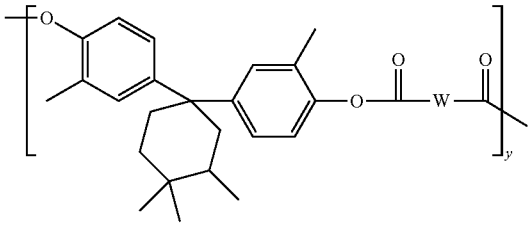

; and

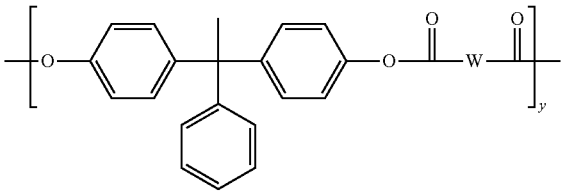

wherein W is an aromatic moiety or an aliphatic moiety, and y is from about 1 to about 6.

8. The flexible imaging member of claim 1, wherein the block (B) organic acid containing repeating unit in the A-B diblock copolymer is selected from the group consisting of:

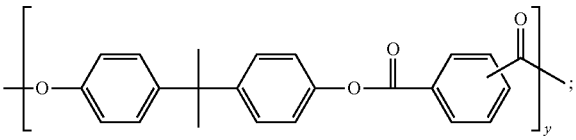

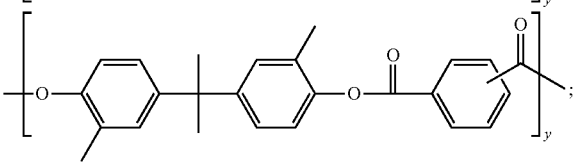

-continued

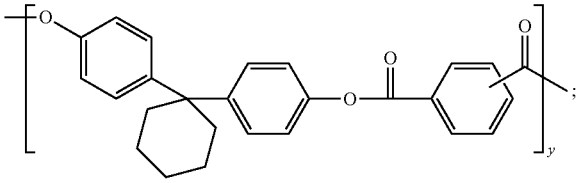

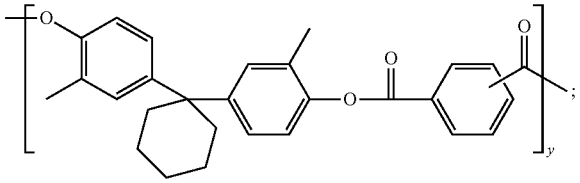

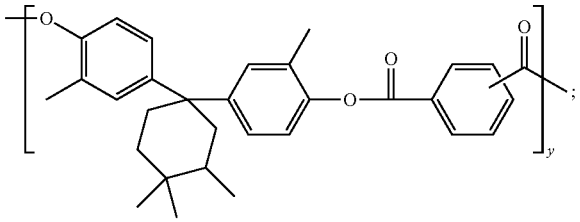

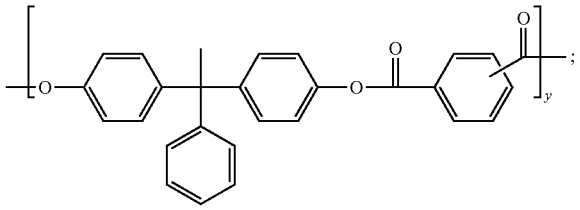

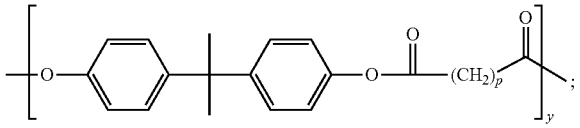

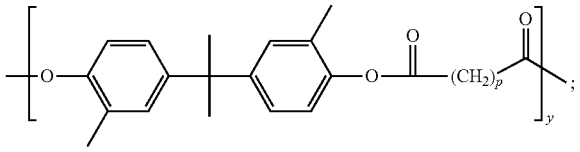

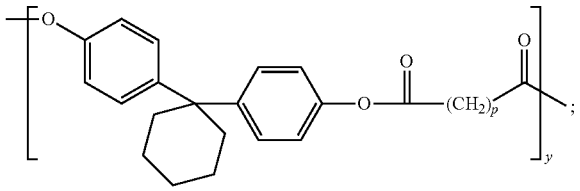

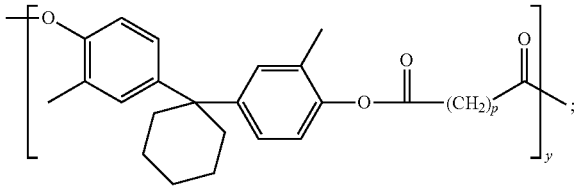

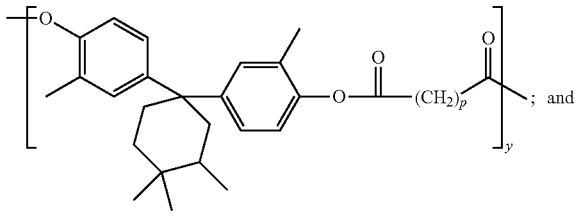

; and

-continued

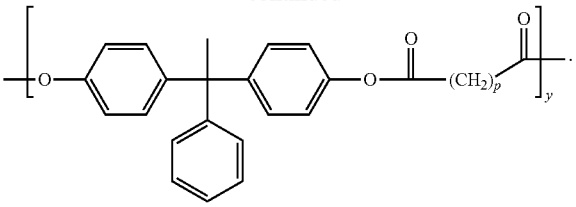

wherein p is from 3 to 8 or from 4 to 6; and y is from about 1 to about 6.

9. The flexible imaging member of claim 8, wherein the block (B) organic acid containing repeating unit W in the A-B diblock copolymer is an aromatic moiety or an aliphatic moiety derived from an aromatic or a dicarboxylic acid selected from the group consisting of

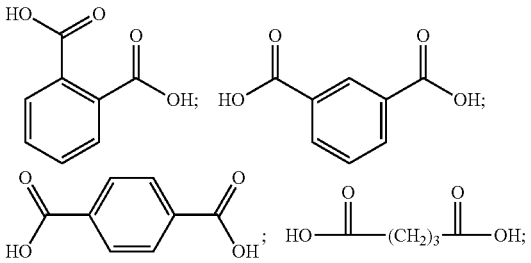

-continued

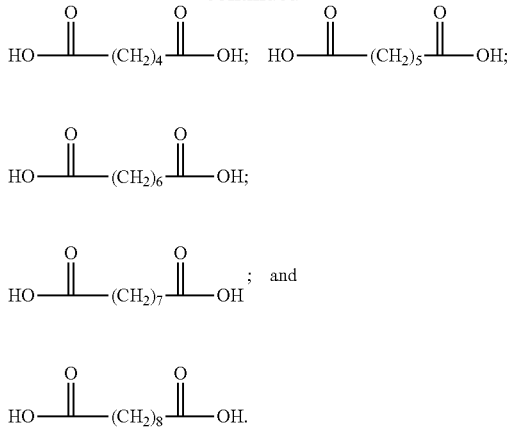

10. The flexible imaging member of claim 1, wherein the plasticized charge transport layer comprises multiple layers including at a least a bottom charge transport layer and a top exposed charge transport layer.

11. The flexible imaging member of claim 10, wherein the amount of charge transport component present in the multiple plasticized charge transport layers decreases in continuum from the bottom charge transport layer to the top exposed charge transport layer.

12. The flexible imaging member of claim 1, wherein the A-B di-block copolymer is selected from the group consisting of:

Formula (1)

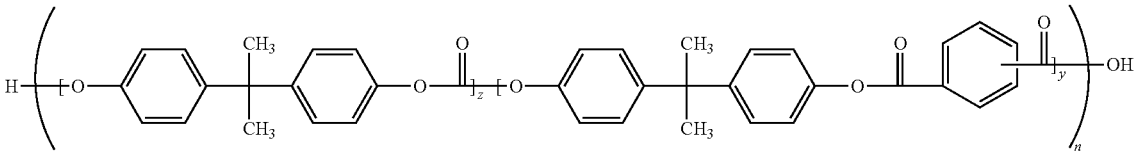

Formula (2)

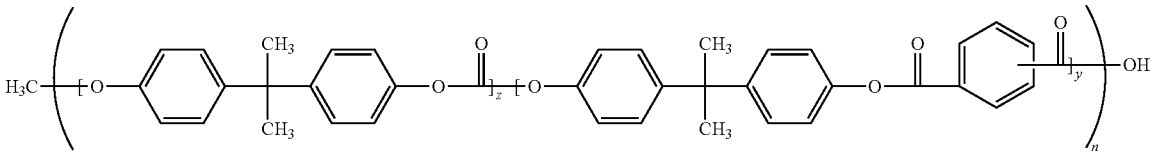

wherein z represents the number of bisphenol A repeating units in segmental block (A) of from about 9 to about 18, y is number of repeating phthalic acid segmental block (B) of from about 1 to about 2, n is the degree of polymerization and is between about 20 and about 90, and the copolymer has a weight average molecular weight of between about 80,000 and about 250,000.

13. A flexible imaging member comprising:

a flexible substrate;

a single plasticized imaging layer disposed on the substrate, wherein the single plasticized imaging layer disposed on the substrate has both charge generating and charge transporting capability and the single plasticized imaging layer comprises a photo-generating pigment and charge transport compound molecularly dispersed or dissolved in an A-B diblock copolymer binder and a plasticizer to form a solid solution, the A-B diblock copolymer binder comprising a bisphenol polycarbonate block (A) and an organic acid containing block (B) and having a general formula of:

$$R_1-(\text{[Block A]}_z-\text{[Block B]}_y)_n-OH$$

wherein block A is a polycarbonate repeating unit, block B is an organic acid containing repeating unit, z is from about 9 to about 54, y is from about 1 to about 6, n is between about 20 and about 80, and $R_1$ is H or $CH_3$, and further wherein the single imaging layer comprises a vinyl-containing plasticizer selected from the group consisting of Formula (A2)

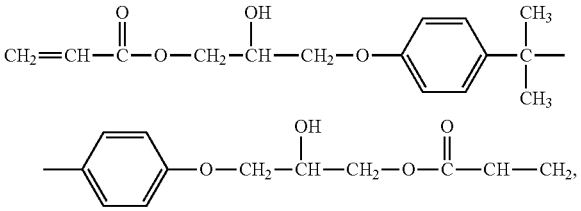

Formula (A3)

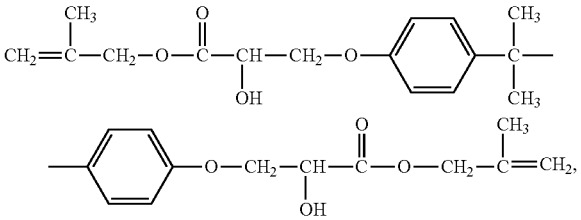

Formula (A4)

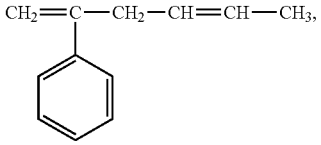

Formula (A5)

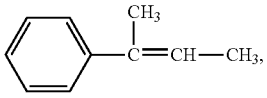

-continued

Formula (A8)

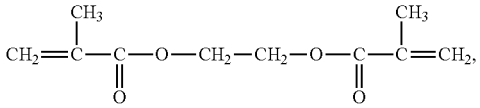

Formula (A9)

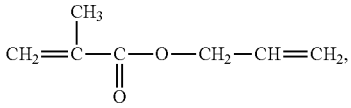

Formula (A10)

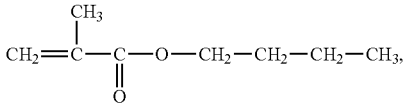

Formula (A11)

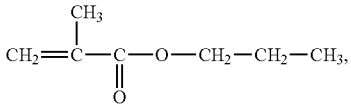

Formula (A12)

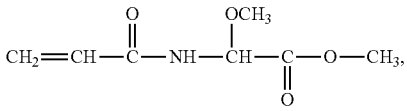

Formula (A13)

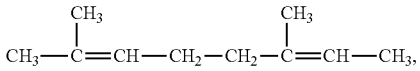

Formula (A14)

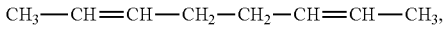

and mixtures thereof.

14. An image forming apparatus for forming images on a recording medium comprising:

a) a flexible imaging member having a charge retentive-surface for receiving an electrostatic latent image thereon, wherein the imaging member comprises a flexible substrate;

a charge generating layer disposed on a first side of the substrate; and at least one plasticized charge transport layer disposed on the charge generating layer, wherein the charge transport layer comprises a charge transport compound molecularly dispersed or dissolved in an A-B diblock copolymer binder and a plasticizer to form a solid solution, the A-B diblock copolymer binder comprising a bisphenol polycarbonate block (A) and an organic acid containing block (B) and having a general formula of:

$$R_1-(\text{[Block A]}_z-\text{[Block B]}_y)_n-OH$$

wherein block (A) is a polycarbonate repeating unit, block (B) is an organic acid containing repeating unit, z is from about 9 to about 54, y is from about 1 to about 6, n is between about 20 and about 80, and $R_1$ is H or $CH_3$, and further wherein the charge transport layer comprises a vinyl-containing plasticizer selected from the group consisting of Formula (A2)

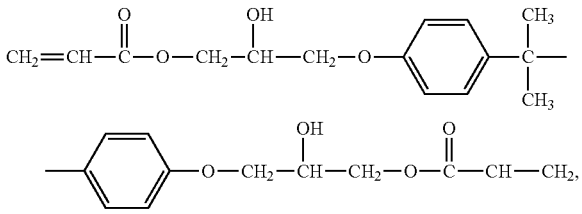

Formula (A3)

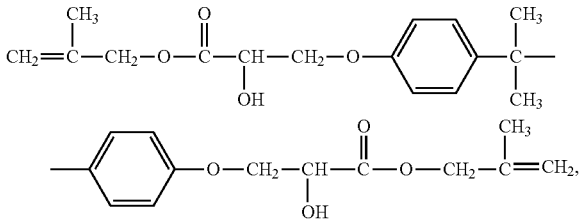

Formula (A4)

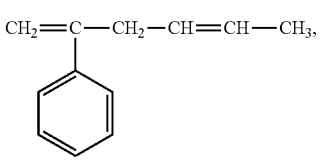

Formula (A5)

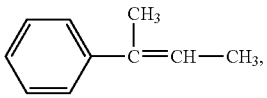

Formula (A8)

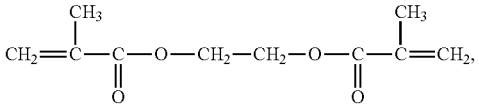

-continued

Formula (A9)

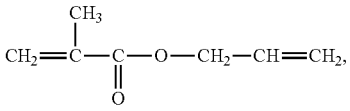

-continued

Formula (A10)

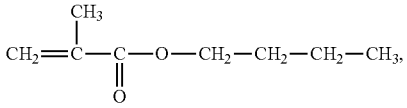

Formula (A11)

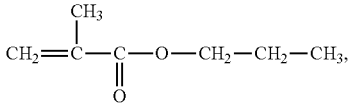

Formula (A12)

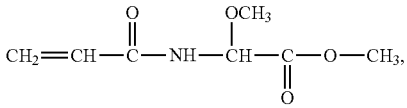

Formula (A13)

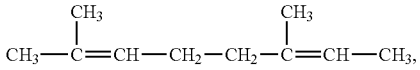

Formula (A14)

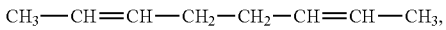

and mixtures thereof;

b) a development component for applying a developer material to the charge-retentive surface to develop the electrostatic latent image to form a developed image on the charge-retentive surface;

c) a transfer component for transferring the developed image from the charge-retentive surface to a copy substrate; and d) a fusing component for fusing the developed image to the copy substrate.

15. The flexible imaging member of claim 14, wherein the A-B di-block copolymer is selected from the group consisting of:

Formula (A1)

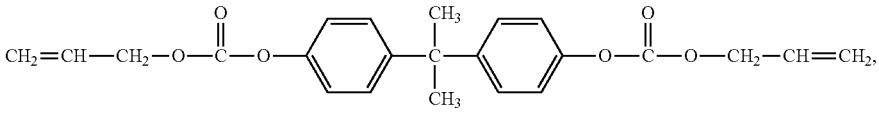

Formula (A2)

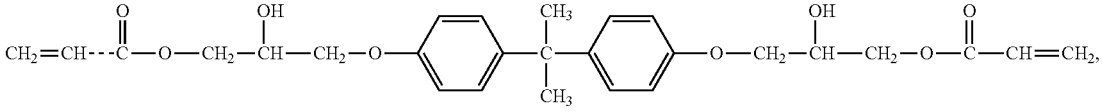

Formula (A3)

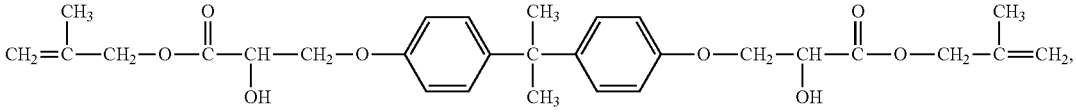

wherein z represents the number of bisphenol A repeating units in segmental block (A) of from about 9 to about 18, y is number of repeating phthalic acid segmental block (B) of from about 1 to about 2, n is the degree of polymerization and is between about 20 and about 90, and the copolymer has a weight average molecular weight of between about 80,000 and about 250,000.

* * * * *